US011378321B2

(12) United States Patent
Ishimizu et al.

(10) Patent No.: US 11,378,321 B2
(45) Date of Patent: Jul. 5, 2022

(54) ICE MAKING MACHINE

(71) Applicant: NIDEC SANKYO CORPORATION, Nagano (JP)

(72) Inventors: Akio Ishimizu, Nagano (JP); Shunji Saito, Nagano (JP); Katsuhiko Hayashi, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 194 days.

(21) Appl. No.: 16/474,070

(22) PCT Filed: Sep. 25, 2018

(86) PCT No.: PCT/JP2018/035249
§ 371 (c)(1),
(2) Date: Jun. 27, 2019

(87) PCT Pub. No.: WO2019/106923
PCT Pub. Date: Jun. 6, 2019

(65) Prior Publication Data

US 2020/0003470 A1 Jan. 2, 2020

(30) Foreign Application Priority Data

Nov. 30, 2017 (JP) ..... JP2017-229914

(51) Int. Cl.
*F25C 1/243* (2018.01)
*F25C 1/10* (2006.01)
*F25C 1/25* (2018.01)

(52) U.S. Cl.
CPC ..... *F25C 1/243* (2013.01); *F25C 1/10* (2013.01); *F25C 1/25* (2018.01); *F25C 2305/022* (2013.01)

(58) Field of Classification Search
CPC .... F25C 1/243; F25C 1/25; F25C 1/10; F25C 2305/022; F25C 2500/02
(Continued)

(56) References Cited

U.S. PATENT DOCUMENTS 2,996,895 A * 8/1961 Lippincott ..... F25C 1/04 62/340
3,306,064 A * 2/1967 Poolos ..... F25C 1/25 62/353

(Continued)

FOREIGN PATENT DOCUMENTS

CN 101960241 1/2011
JP S467965 3/1971

(Continued)

OTHER PUBLICATIONS

"International Search Report (Form PCT/ISA/210) of PCT/JP2018/035249," dated Dec. 11, 2018, with English translation thereof, pp. 1-4.

(Continued)

*Primary Examiner* — Eric S Ruppert
*Assistant Examiner* — Kirstin U Oswald
(74) *Attorney, Agent, or Firm* — JCIPRNET

(57) ABSTRACT

An ice making machine is provided and includes: an ice tray, having a water storage recessed part; a drive part for reversing the ice tray around an axial line passing the ice tray between a water storage position and an ice separation position; and a frame, supporting the ice tray and the drive part. The ice tray includes a water receiving part protruded to an outer side in a portion which is moved to a lower side when the ice tray starts to turn to a CCW direction directing from the water storage position to the ice separation position. The frame includes a projected portion located on an upper side with respect to the water receiving part. The (Continued)

projected portion includes a water passage port for passing the water at a position overlapping with the water receiving part when being viewed in a Z-direction.

12 Claims, 12 Drawing Sheets

(58) Field of Classification Search
USPC ..... 62/340
See application file for complete search history.

(56) References Cited

U.S. PATENT DOCUMENTS

| | | | | |
|---|---|---|---|---|
| 3,788,089 | A * | 1/1974 | Graves | F25C 1/04 62/340 |
| 4,649,717 | A * | 3/1987 | Tate, Jr. | F25C 1/04 62/340 |
| 4,649,718 | A | 3/1987 | Linstromberg et al. | |
| 7,146,820 | B2 * | 12/2006 | Comerci | F25C 5/04 62/353 |
| 8,047,015 | B2 * | 11/2011 | An | F25C 1/25 62/340 |
| 9,004,325 | B2 * | 4/2015 | Licht | B67D 1/0857 62/340 |
| 9,316,425 | B2 * | 4/2016 | Mitchell | F25C 1/00 |
| 2003/0192336 | A1 * | 10/2003 | Kim | F25C 1/04 62/340 |
| 2006/0032262 | A1 * | 2/2006 | Seo | F25C 1/20 62/340 |
| 2008/0148750 | A1 * | 6/2008 | Hsu | F25C 1/25 62/188 |
| 2011/0185759 | A1 * | 8/2011 | Kang | F25C 1/25 62/340 |
| 2012/0023996 | A1 * | 2/2012 | Herrera | F25C 1/04 249/70 |
| 2012/0180504 | A1 * | 7/2012 | An | F25C 5/06 62/340 |
| 2013/0014535 | A1 * | 1/2013 | Son | F25C 1/10 62/340 |
| 2013/0081412 | A1 * | 4/2013 | Son | F25C 1/04 62/340 |
| 2013/0327074 | A1 * | 12/2013 | Lee | F25C 1/25 62/177 |
| 2014/0182325 | A1 * | 7/2014 | Lee | F25C 1/04 62/340 |
| 2015/0135757 | A1 * | 5/2015 | Mitchell | F25C 1/00 62/340 |
| 2015/0241102 | A1 * | 8/2015 | Lee | F25C 1/10 62/344 |
| 2016/0010911 | A1 * | 1/2016 | Kuroda | F25C 1/04 62/340 |
| 2016/0054042 | A1 * | 2/2016 | May | F25C 5/22 62/340 |

FOREIGN PATENT DOCUMENTS

| | | |
|---|---|---|
| JP | S4954150 | 5/1974 |
| JP | H07305930 | 11/1995 |
| JP | 2001004256 A * | 1/2001 |
| JP | 2008057897 | 3/2008 |
| JP | 2012-207824 | 10/2012 |
| JP | 2013234811 | 11/2013 |
| WO | 2018163453 | 9/2018 |

OTHER PUBLICATIONS

"Office Action of China Counterpart Application", dated Aug. 31, 2020, with English translation thereof, pp. 1-15.

* cited by examiner

ICE MAKING MACHINE

CROSS-REFERENCE TO RELATED APPLICATION

This application is a 371 application of the international PCT application serial no. PCT/JP2018/035249, filed on Sep. 25, 2018, which claims the priority benefits of Japan application no. 2017-229914, filed on Nov. 30, 2017. The entirety of each of the abovementioned patent applications is hereby incorporated by reference herein and made a part of this specification.

TECHNICAL FIELD

The present invention relates to an ice making machine which is structured to store water supplied through a water supply pipe and make ice pieces.

BACKGROUND ART

An ice making machine mounted on a refrigerator is described in Patent Literature 1. The ice making machine described in the Patent literature includes an ice tray provided with water storage recessed parts, a drive part for reversing the ice tray around an axial line passing the ice tray, and a frame which supports the ice tray and the drive part. In the ice making machine, water supplied from a water supply pipe is filled in the water storage recessed parts to perform ice making. Further, when ice making is completed, the ice making machine reverses the ice tray by the drive part and makes a part of the ice tray abut with the frame to twist the ice tray. As a result, ice pieces are separated from the ice tray and dropped to an ice storage container which is disposed on a lower side. In the Patent literature, a water supply port of the water supply pipe is located on upper side with respect to the ice tray and water is directly poured into the ice tray.

CITATION LIST

Patent Literature

[Patent Literature 1] Japanese Patent Laid-Open No. 2012-207824

SUMMARY

Technical Problems

In a case that a water supply pipe is disposed on an upper side with respect to the ice tray, the water supply pipe is required to separate from a turning area of the ice tray to an upper side so that a water supply port of the water supply pipe is not interfered with the ice tray which is reversed (turned). Therefore, an installation space of the ice making machine including the water supply pipe is increased in an upper and lower direction.

In view of the problem described above, the present invention provides an ice making machine whose installation space including the water supply pipe can be restrained in an upper and lower direction.

Solutions to Problems

To solve the above-mentioned problem, the present invention provides an ice making machine including an ice tray provided with a water storage recessed part structured to store water supplied through a water supply pipe, a drive part structured to reverse the ice tray around an axial line passing the ice tray between a water storage position where the water storage recessed part faces upward and an ice separation position where the water storage recessed part faces downward, and a frame which supports the ice tray and the drive part. The ice tray is provided with a water receiving part protruded to an outer side in an ice tray portion which is moved to a lower side when the ice tray starts to turn to a first turning direction directing from the water storage position to the ice separation position, and the frame is provided with a frame portion located on an upper side with respect to the water receiving part. The frame portion is provided with a water passage port structured to pass the water at a position overlapping with the water receiving part when the ice tray located at the water storage position is viewed in an upper and lower direction, the water receiving part is communicated with the water storage recessed part, and the water through the water supply pipe is passed through the water passage port and is flowed to the water receiving part and is flowed to the water storage recessed part.

In the present invention, water through the water supply pipe is passed through the water passage port provided in the frame and flowed to the water receiving part, which is protruded from the ice tray to an outer side, and is flowed to the water storage recessed part through the water receiving part. Therefore, the water supply port of the water supply pipe can be located outside the ice tray. As a result, the water supply port of the water supply pipe is not required to dispose at a position separated from a turning area of the ice tray on an upper side with respect to the ice tray and thus, an installation space of the ice making machine including the water supply pipe can be restrained in the upper and lower direction. In this case, the water receiving part provided in the ice tray is moved to a lower side when the ice tray starts to turn to the first turning direction directing from the water storage position to the ice separation position. In other words, when the ice tray is turned to the first turning direction, the water receiving part is moved in a direction separated from a frame portion provided with the water passage port. Therefore, even when the ice tray is provided with the water receiving part which is protruded, the water receiving part is not interfered with the frame portion.

In the present invention, it may be structured that the water receiving part is protruded from the ice tray in a direction along the axial line. According to this structure, in comparison with a case that the water receiving part is protruded from the ice tray in a direction perpendicular to the axial line, a turning area when the ice tray is reversed can be reduced. Therefore, the ice making machine can be restrained from enlarging in a direction perpendicular to the axial line.

In the present invention, it is desirable that the drive part is connected with one side in the axial direction of the ice tray, and the water receiving part is protruded to the outer side from a portion on the other side in the axial direction in the ice tray portion. According to this structure, even when water flowed to the water receiving part is splashed, the drive part can be prevented or restrained from being sprayed with the water.

In the present invention, it is desirable that the ice tray is made of flexible material, and the frame is provided with an abutting part structured to abut with the water receiving part from a front side in the first turning direction when the ice tray is turned in the first turning direction and has reached the ice separation position and, thereby turning of the ice tray driven to the first turning direction is prevented. According to this structure, when the water receiving part and the abutting part are abutted with each other and turning of the ice tray is prevented, the ice tray is twisted. Therefore, when having reached the ice separation position, ice pieces are easily separated from the ice tray.

In the present invention, it is desirable that the frame portion is provided with a water passage which is extended in a direction intersecting the axial line on an upper face of the frame portion, the water passage port is provided in a bottom face of the water passage, and the bottom face of the water passage is provided with an upper face inclined to a lower side toward the water passage port. According to this structure, when a water supply port of the water supply pipe is disposed on an upper side with respect to the water passage, water through the water supply pipe can be flowed to the water storage recessed part of the ice tray. Therefore, a degree of freedom of arrangement of the water supply pipe is improved. Further, when the bottom face of the water passage is inclined to a lower side toward the water passage port, water in the water passage is flowed toward the water passage port without stagnating. Further, when water supply is stopped, a situation that water is left in the water passage and frozen is prevented or restrained.

In the present invention, it is desirable that the frame portion is provided with a guide plate which is protruded from the water passage port to a lower side and guides the water passing through the water passage port to the water receiving part. According to this structure, water having passed through the water passage port can be surely flowed to the water receiving part.

In the present invention, it is desirable that, in a case that the water passage port is provided with a first opening edge portion extended in a direction intersecting the axial line in a bottom face of the water passage, and a second opening edge portion and a third opening edge portion which are respectively extended from one end and the other end of the first opening edge portion to a side where the water storage recessed part is located in the bottom face of the water passage, the guide plate is extended from the first opening edge portion to the lower side. When a portion provided with the guide plate is only the first opening edge portion, different from a case that a guide plate is provided in the second opening edge portion and the third opening edge portion, a corner part formed by connecting the guide plates to which water is adhered is not formed. Therefore, water is hard to be left on the guide plate and thus, occurrence of a situation that the water passage port is closed due to freezing, or that water is hard to pass through the water passage port due to freezing can be reduced.

In the present invention, it is desirable that the guide plate is provided with a groove which is extended to the lower side in at least a part of the guide plate, and the groove is extended to a lower end of the guide plate. When the guide plate is provided with a groove, water adhered to the guide plate can be gathered to the groove. Therefore, water is easily flowed to a lower side. Further, when the groove is extended to a lower end of the guide plate, water gathered to the groove is easily flowed to the water receiving part. Therefore, occurrence of a situation that the water passage port is closed due to freezing of water adhered to the guide plate, or that water is hard to pass through the water passage port due to freezing can be reduced.

In the present invention, it is desirable that a plurality of the grooves is arranged side by side in a direction intersecting a direction toward the lower end of the guide plate. According to this structure, grooves can be provided over a wide area and thus water is hard to be left in the guide face.

In the present invention, it is desirable that the frame portion is provided with a first water passage wall which is stood up from a bottom face of the water passage to an upper side on a side where the water storage recessed part is located with respect to the water passage, and the water passage port is provided with a first water passage port portion provided in the bottom face of the water passage and a second water passage port portion which is provided in the first water passage wall and is connected with the first water passage port portion. As described above, when the water passage port is enlarged to a side face (first water passage wall) on a water storage recessed part side in addition to the bottom face of the water passage, water is easily flowed out to a direction toward the water storage recessed part. Therefore, water is hard to splash to a direction different from the water storage recessed part.

In the present invention, it is desirable that the ice tray is provided with a peripheral wall part which surrounds an opening of the water storage recessed part and is extended to an upper side when the ice tray is disposed at the water storage position, and a cut-out part provided in a part in a circumferential direction of the peripheral wall part, and the water receiving part is protruded from the peripheral wall part to an outer side and is communicated with the water storage recessed part through the cut-out part. According to this structure, water flowed to the water receiving part is easily flowed to the water storage recessed part. Further, the ice tray is provided with the peripheral wall part and thus, water flowed from the water receiving part to the water storage recessed part through the cut-out part can be prevented from splashing from the ice tray to an outer side.

In the present invention, it may be structured that the water receiving part is, when the ice tray is disposed at the water storage position, provided with a bottom part which is protruded to the outer side from an edge portion on a lower side of the cut-out part in the peripheral wall part and faces the frame portion, a pair of side plate parts which are respectively protruded to the outer side from an edge portion on one side and an edge portion on the other side of the cut-out part in the circumferential direction of the peripheral wall part, and lower ends of the pair of the side plate parts being continuously connected with the bottom part, and an end plate part which is continuously connected with a tip end portion of the bottom part and tip end portions of the pair of the side plate parts. In addition, the bottom part is inclined to a lower side from a side of the end plate part toward a side of the peripheral wall part. According to this structure, water which is passed through the water passage port and is flowed to the water receiving part can be guided to the water storage recessed part.

In the present invention, it is desirable that the ice tray is provided with a peripheral wall part which surrounds an opening of the water storage recessed part and is extended to an upper side when the ice tray is disposed at the water storage position, and a cut-out part provided in a part in a circumferential direction of the peripheral wall part, the water receiving part is, when the ice tray is disposed at the water storage position, provided with a bottom part which is protruded to the outer side from an edge portion on a lower side of the cut-out part in the peripheral wall part and faces the frame portion, a pair of side plate parts which are respectively protruded to the outer side from an edge portion on one side and an edge portion on the other side of the cut-out part in the circumferential direction of the peripheral wall part, and lower ends of the pair of the side plate parts being continuously connected with the bottom part, and an end plate part which is continuously connected with a tip end portion of the bottom part and tip end portions of the pair of the side plate parts. In addition, a lower end of the guide plate is located on a lower side with respect to upper ends of the pair of the side plate parts when the ice tray is disposed at the water storage position. According to this structure, water which is passed through the water passage port and is flowed to the water receiving part is prevented or restrained from splashing from the water receiving part to an outer side.

Effect of the Invention

According to the present invention, water through the water supply pipe is passed through the water passage port provided in the frame and flowed to the water receiving part, which is protruded from the ice tray to an outer side, and is flowed to the water storage recessed part through the water receiving part. Therefore, the water supply port of the water supply pipe can be located outside the ice tray. As a result, the water supply port of the water supply pipe is not required to dispose at a position separated from a turning area of the ice tray on an upper side with respect to the ice tray and thus, an installation space of the ice making machine including the water supply pipe can be restrained in the upper and lower direction.

DESCRIPTION OF EMBODIMENTS

An ice making machine in accordance with an embodiment of the present invention will be described below with reference to the accompanying drawings.

(Entire Structure)

Figure 1:
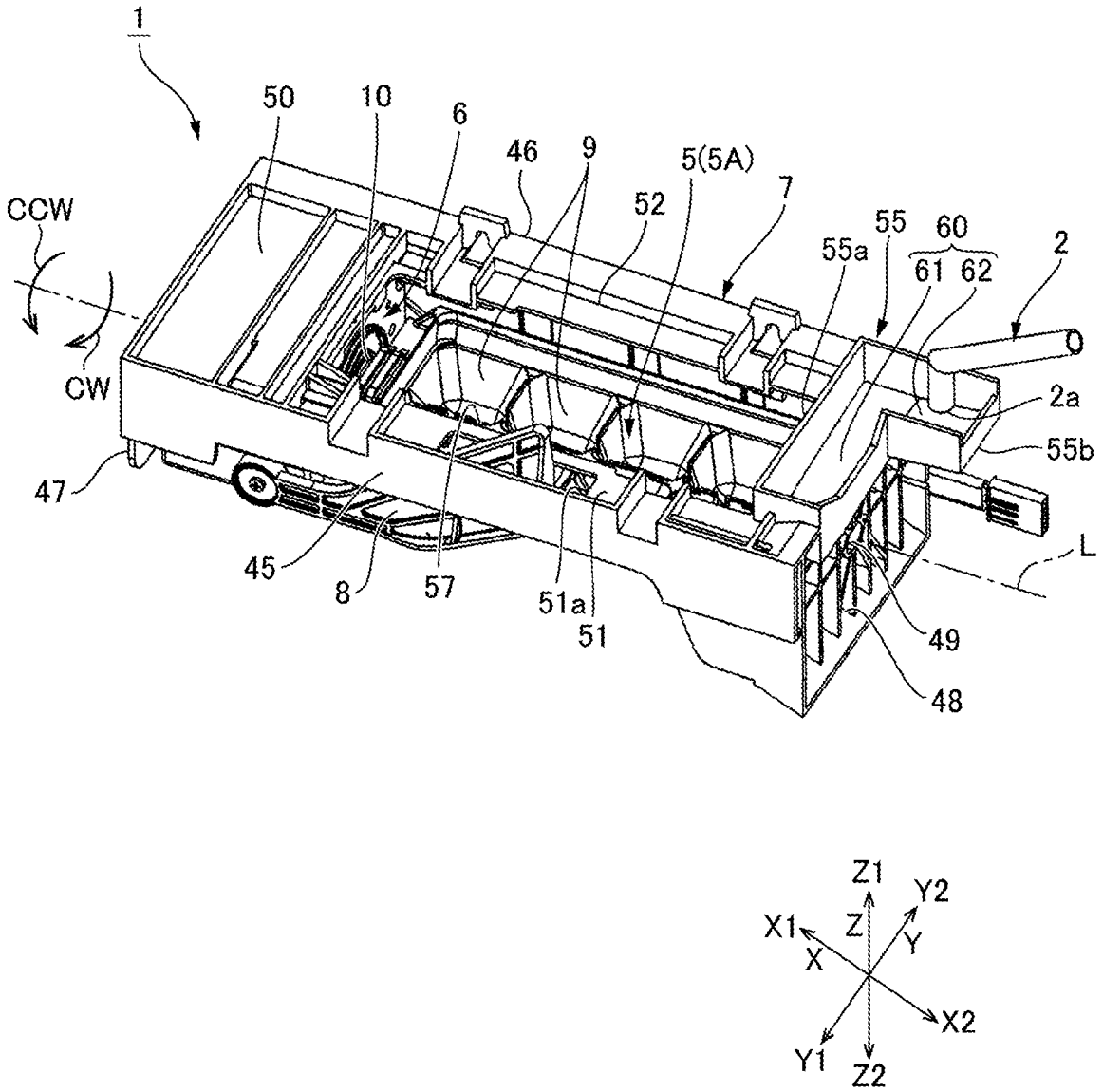
FIG. 1 is a perspective view showing an ice making machine to which the present invention is applied and which is viewed from an upper side.
Figure 2:
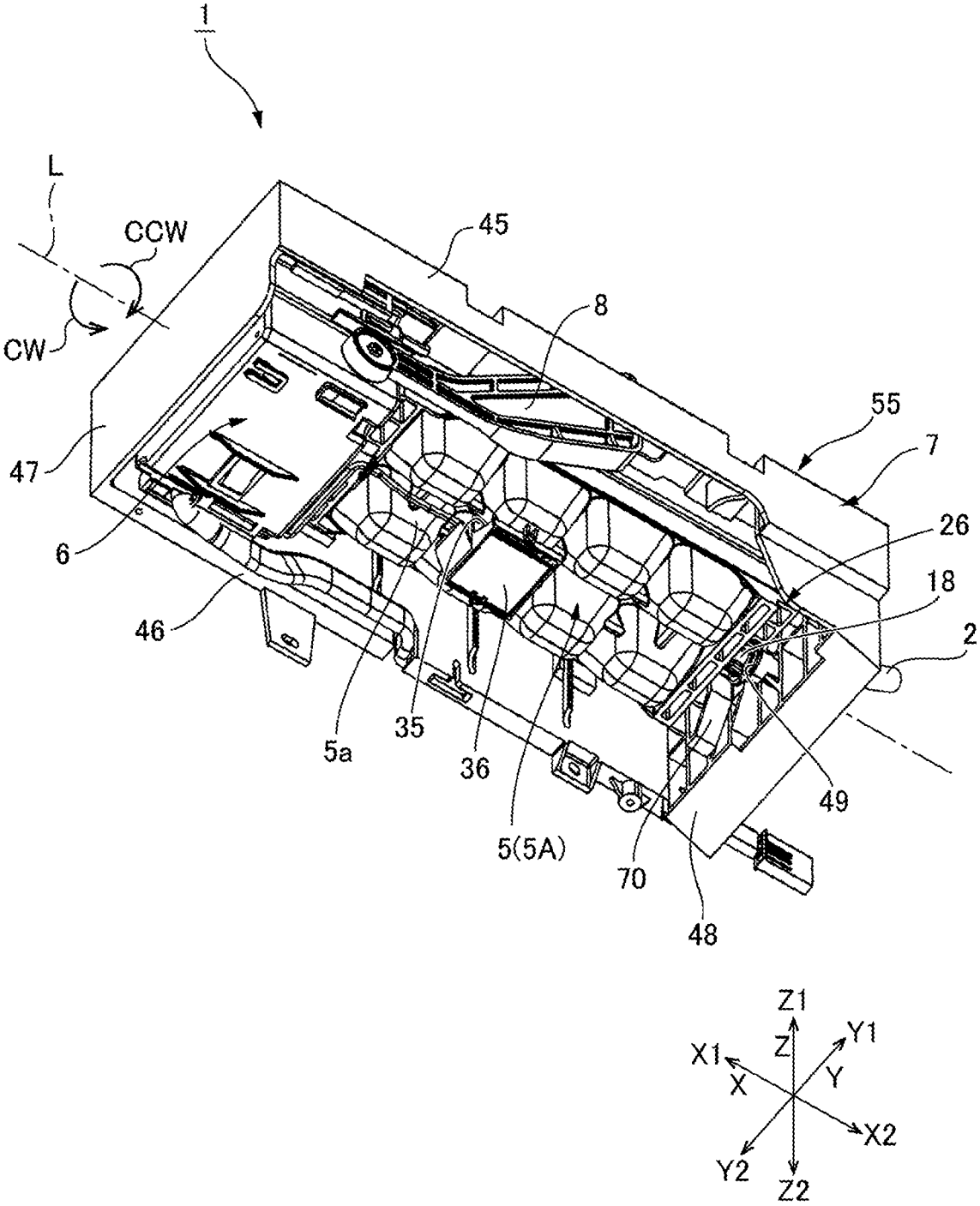
FIG. 2 is a perspective view showing an ice making machine in which an ice tray is located at a water storage position and which is viewed from a lower side.
Figure 3:
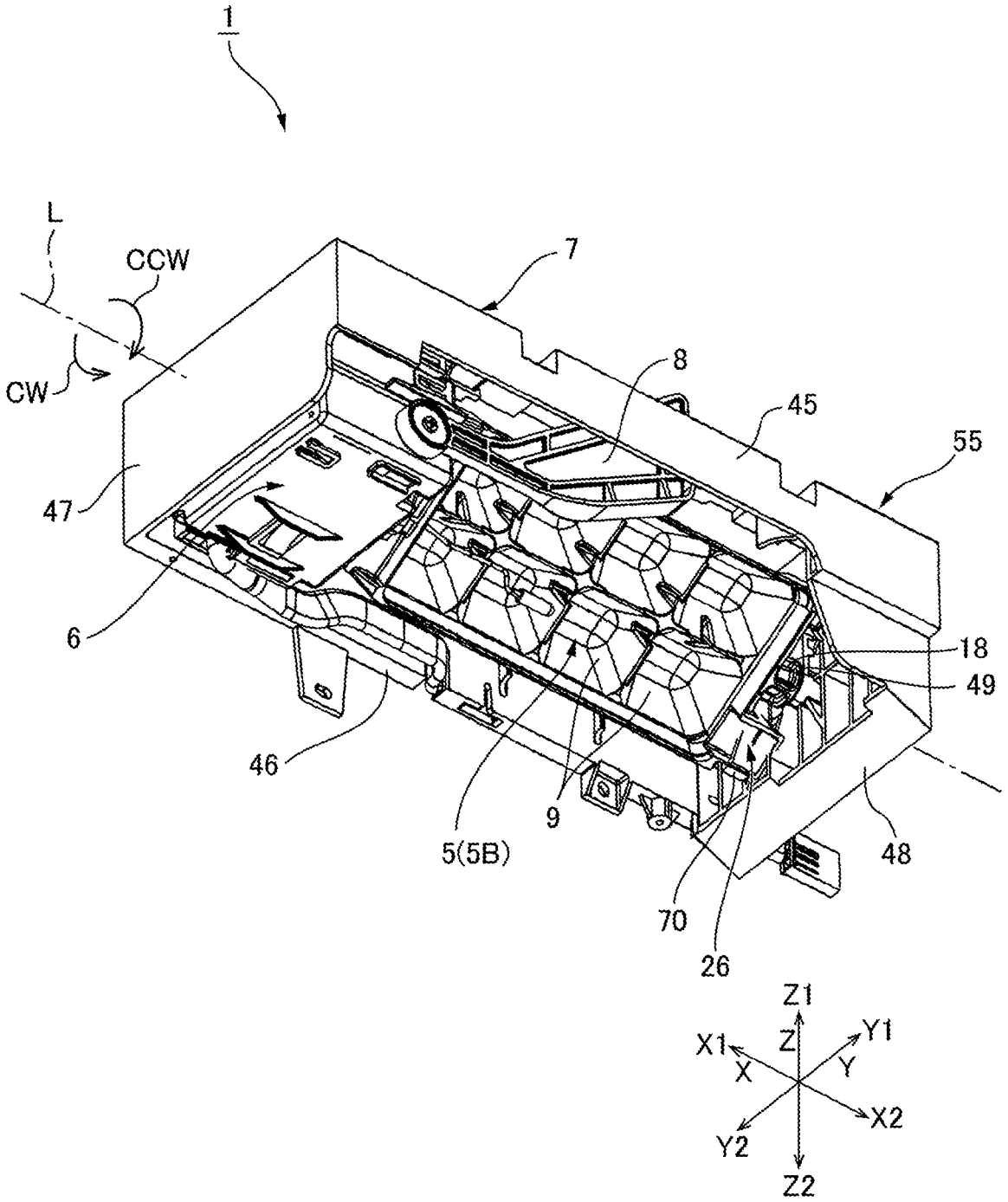
FIG. 3 is a perspective view showing an ice making machine in which an ice tray is located at an ice separation position and which is viewed from a lower side.
Figure 4:
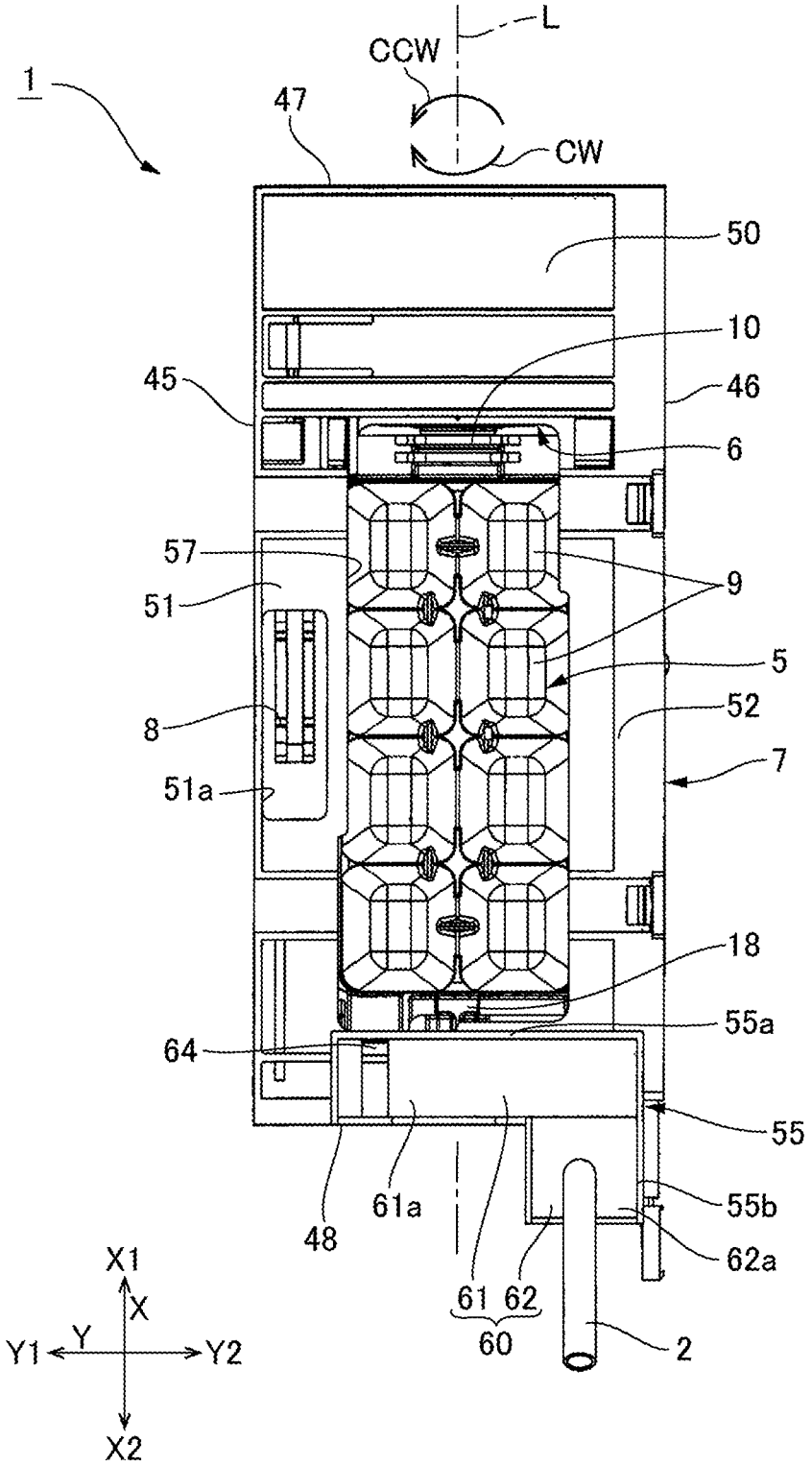
FIG. 4 is a plan view showing an ice making machine.
Figure 5:
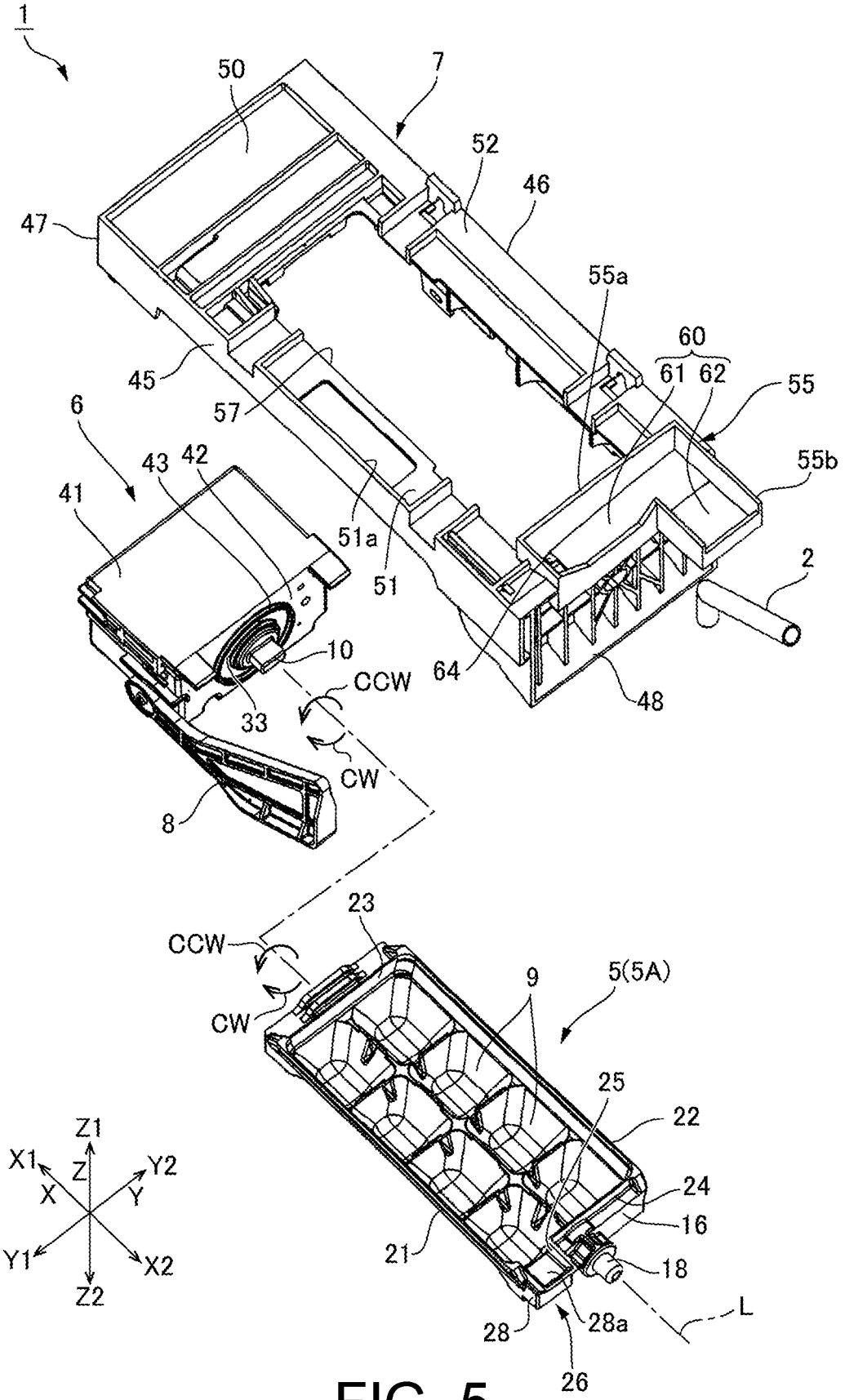
FIG. 5 is an exploded perspective view showing an ice making machine.

FIG. 1 is a perspective view showing an ice making machine to which the present invention is applied and which is viewed from an upper side. FIG. 2 is a perspective view showing an ice making machine in FIG. 1 which is viewed from a lower side. In FIGS. 1 and 2, an ice tray of an ice making machine is located at a water storage position. FIG. 3 is a perspective view showing an ice making machine in which an ice tray is located at an ice separation position and which is viewed from a lower side. FIG. 4 is a plan view showing an ice making machine. FIG. 5 is an exploded perspective view showing an ice making machine.

An ice making machine 1 is mounted on a refrigerator. As shown in FIG. 1, the ice making machine 1 includes an ice tray 5, a drive part 6 structured to reverse the ice tray 5, and a frame 7 which supports the ice tray 5 and the drive part 6. A planar shape of the ice tray 5 is a substantially rectangular shape. The ice tray 5 is provided with a plurality of water storage recessed parts 9 in which water supplied through a water supply pipe 2 is stored. The drive part 6 reverses the ice tray 5 around an axial line "L" passing a center portion in a shorter direction of the ice tray 5 in a longitudinal direction. An output shaft 10 of the drive part 6 is connected with an end portion on one side in the axial line "L" direction of the ice tray 5. The ice tray 5 is turned between a water storage position 5A where the water storage recessed parts 9 face upward and an ice separation position 5B where the water storage recessed parts 9 face downward by driving the drive part 6. FIG. 1 shows a state that the ice tray 5 is disposed at the water storage position 5A. FIG. 3 shows a state that the ice tray 5 is disposed at the ice separation position 5B.

The ice making machine 1 is structured, as shown in FIGS. 1 and 2, so that the ice tray 5 is disposed at the water storage position 5A and water supplied through the water supply pipe 2 is stored in the water storage recessed parts 9 of the ice tray 5 to perform ice making. When the ice making is completed, as shown in FIG. 3, the ice making machine 1 drives the drive part 6 to turn the ice tray 5 from the water storage position 5A to the ice separation position 5B and to drop ice pieces of the ice tray 5 to an ice storage container (not shown) which is disposed on a lower side with respect to the ice making machine 1.

In the following descriptions, three directions perpendicular to each other are defined as an "X" direction, a "Y" direction and a "Z" direction. The "X" direction is the axial line "L" direction. The "Z" direction is an upper and lower direction in an installation posture (posture shown in FIG. 1) of the ice making machine 1. The "Y" direction is a direction perpendicular to the axial line "L" direction and the upper and lower direction. Further, in the "X" direction, a side where the drive part 6 is located is defined as an "X1" direction, and a side where the ice tray 5 is located is defined as an "X2" direction. In the "Z" direction, an upper side is defined as a "Z1" direction and a lower side is defined as an "Z2" direction. Further, in the "Y" direction, when the ice tray 5 is turned from the water storage position 5A toward the ice separation position 5B around the axial line "L", which is a "CCW" direction (first turning direction), a direction that openings of the water storage recessed parts 9 are directed is defined as a "Y1" direction, and the opposite side is defined as a "Y2" direction.

(Ice Tray)

Figure 6A:
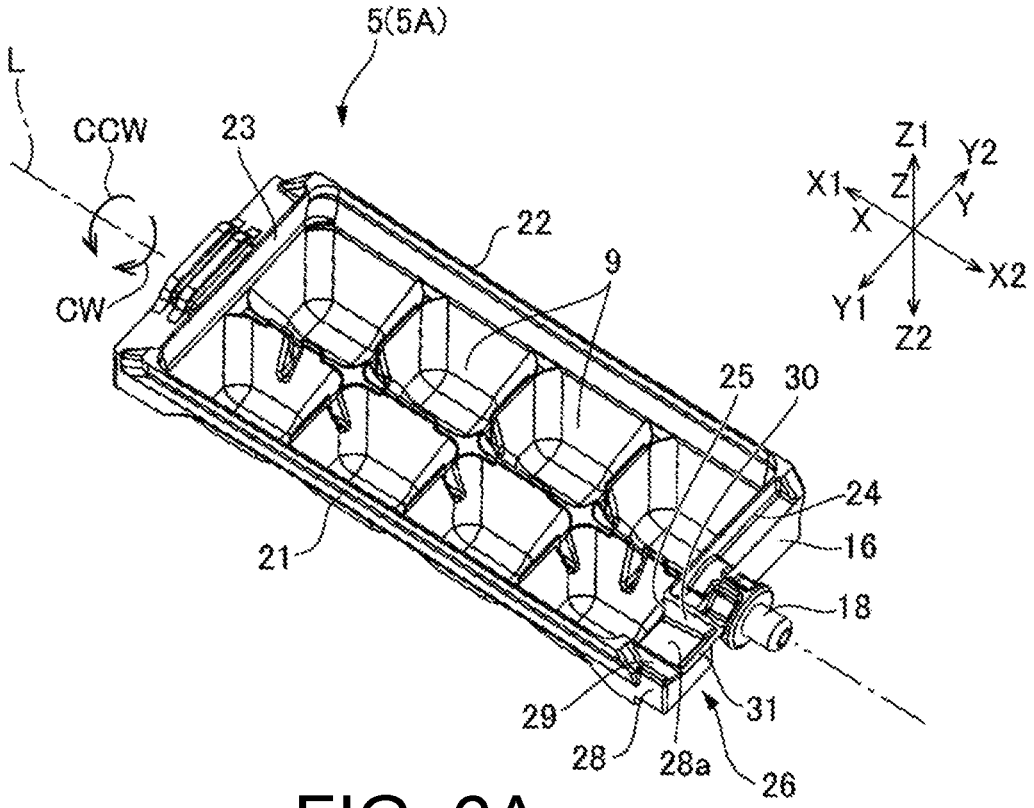
FIGS. 6A and 6B are perspective views showing an ice tray.
Figure 6B:
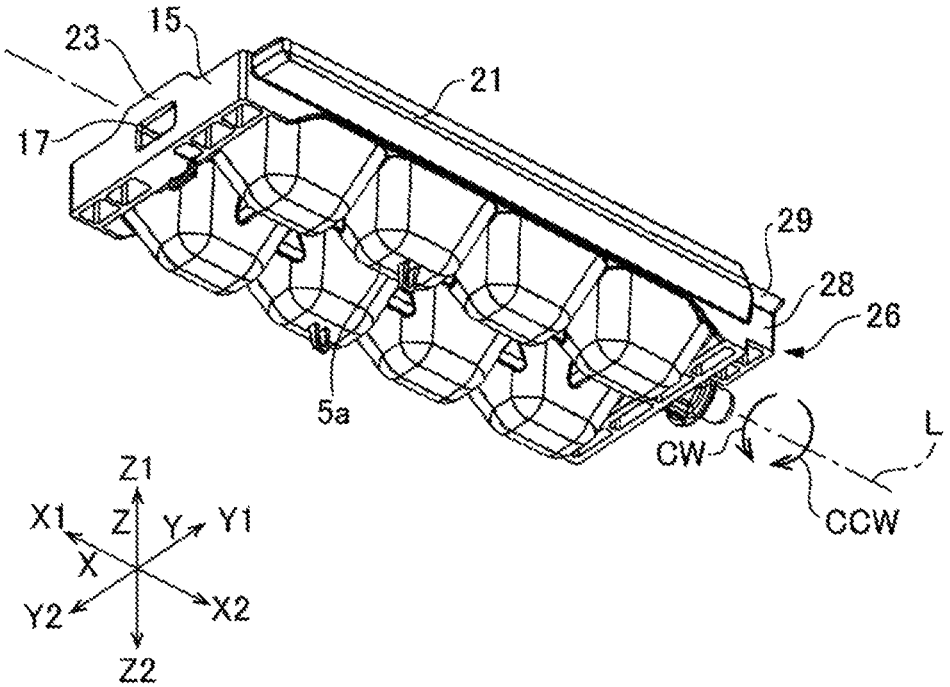
Figure 7:
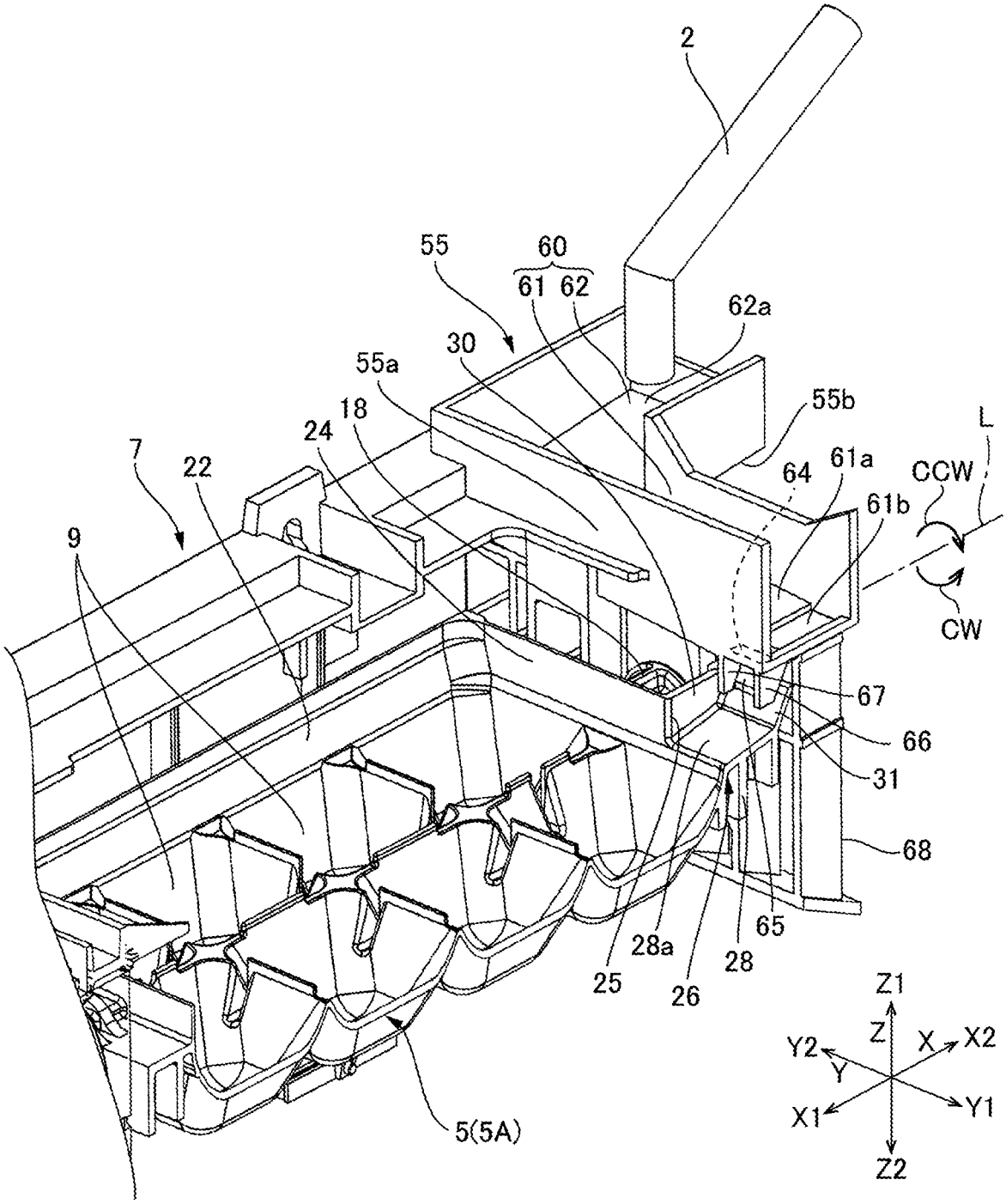
FIG. 7 is a partial sectional view showing a periphery of a water receiving part of an ice tray.

FIG. 6A is a perspective view showing the ice tray 5 viewed from the "Z1" direction, and FIG. 6B is a perspective view showing the ice tray 5 viewed from the "Z2" direction. FIG. 7 is a partial sectional view showing a periphery of a water receiving part of an ice tray. The ice tray 5 is made of elastically deformable material. In this embodiment, the ice tray 5 is made of resin material. As shown in FIGS. 6A and 6B, the ice tray 5 is provided with a first wall part 15 located in the "X1" direction and a second wall part 16 located in the "X2" direction. As shown in FIG. 6B, the first wall part 15 is provided with a connecting part 17 which is connected with an output shaft 10 of the drive part 6. As shown in FIG. 6A, the second wall part 16 is provided with a shaft part 18 coaxially with the connecting part 17. The shaft part 18 is protruded from the second wall part 16 to the "X2" direction. A plurality of the water storage recessed parts 9 is disposed between the first wall part 15 and the second wall part 16. The water storage recessed parts 9 are disposed in four rows in the "X" direction with two water storage recessed parts 9 arranged in the "Y" direction are paired.

Further, the ice tray 5 is provided with a frame-shaped peripheral wall part 20 which surrounds the openings of a plurality of the water storage recessed parts 9 and is extended to an upper side when the ice tray 5 is disposed at the water storage position 5A. The peripheral wall part 20 is provided with a first peripheral wall portion 21 extended in the "X" direction on a side in the "Y1" direction of the plurality of the water storage recessed parts 9, a second peripheral wall portion 22 extended in the "X" direction on a side in the "Y2" direction of the plurality of the water storage recessed parts 9, a third peripheral wall portion 23 which is extended in the "Y" direction and is connected with end portions in the "X1" direction of the first peripheral wall portion 21 and the second peripheral wall portion 22, and a fourth peripheral wall portion 24 which is extended in the "Y" direction and is connected with end portions in the "X2" direction of the first peripheral wall portion 21 and the second peripheral wall portion 22. The first peripheral wall portion 21 and the second peripheral wall portion 22 face each other in the "Y" direction, and the third peripheral wall portion 23 and the fourth peripheral wall portion 24 face each other in the "X" direction. Further, the fourth peripheral wall portion 24 is provided with a cut-out part 25 on a side in the "Y1" direction with respect to the shaft part 18. The cut-out part 25 is formed in a rectangular shape and is extended to the "Z2" direction (lower side) from an upper end edge of the fourth peripheral wall portion 24.

In addition, the ice tray 5 is provided with a water receiving part 26 which is protruded from the fourth peripheral wall portion 24 to the "X2" direction of the "X" direction (axial line "L" direction). The water receiving part 26 is located in the "Y1" direction with respect to the shaft part 18. The water receiving part 26 is provided with a bottom part 28 protruded from an edge portion in the "Z2" direction (lower side) of the cut-out part 25 in the fourth peripheral wall portion 24 to an outer side, a pair of side plate parts 29 and 30 which are respectively protruded from an edge portion in the "Y1" direction and an edge portion in the "Y2" direction of the cut-out part 25 in the fourth peripheral wall portion 24 to an outer side and are continuously connected with the bottom part 28 at their lower ends, and an end plate part 31 which is continuously connected with a tip end portion of the bottom part 28 and tip end portions of the pair of the side plate parts 29 and 30. The bottom part 28 is provided with an upper face 28*a* which is inclined to a lower side from a side of the end plate part 31 to a side of the peripheral wall part 20 (side of the cut-out part 25). Further, the end plate part 31 is inclined to the side of the peripheral wall part 20 (side of the cut-out part 25) toward the bottom part 28. The water receiving part 26 is communicated with the plurality of the water storage recessed parts 9 located on an inner side of the peripheral wall part 20 through the cut-out part 25.

In this embodiment, the water receiving part 26 is provided in a portion located in the "Y1" direction with respect to the shaft part 18 in the ice tray 5. The portion located in the "Y1" direction with respect to the shaft part 18 is a portion of the ice tray which is moved to the "Z2" direction (lower side) when the ice tray 5 starts to turn in the "CCW" direction from the water storage position 5A to the ice separation position 5B.

As shown in FIG. 2, an under face 5*a* in the "Z2" direction of the ice tray 5 is arranged with protruded parts which reflect shapes of the water storage recessed parts 9. A thermistor 35 for detecting a temperature of the ice tray 5 is disposed on the under face 5*a* of the ice tray 5. The thermistor 35 is covered by a cover 36 which is fixed to the under face 5*a* of the ice tray 5.

(Drive Part)

As shown in FIG. 5, the drive part 6 is provided with a case 41 which is formed in a rectangular parallelepiped shape. The case 41 accommodates a motor (not shown) which is a drive source, a rotation transmission mechanism (not shown) structured to transmit a rotating force of the motor, and a cam gear 33 to which the rotating force of the motor is transmitted through the rotation transmission mechanism. The cam gear 33 is integrally formed with an output shaft 10. The output shaft 10 is protruded to an outer side of the case 41 through a hole 43 provided in an end plate 42 in the "X2" direction of the case 41. The output shaft 10 is connected with the connecting part 17 provided in the first wall part 15 of the ice tray 5. The output shaft 10 is turned in a clockwise "CCW" direction with the axial line "L" as a center when the ice tray 5 is turned from the water storage position 5A to the ice separation position 5B. Further, the output shaft 10 is turned in a counterclockwise "CW" direction when the ice tray 5 is returned from the ice separation position 5B to the water storage position 5A.

An ice detection lever 8 is disposed at a position adjacent to the ice tray 5 in the "Y1" direction. In an inside of the case 41 of the drive part 6, an ice detection mechanism, which is structured to operate so as to turn the ice detection lever 8 depending on a turning angle of the cam gear 33 around the axial line "L" in cooperation with the cam gear 33, and a switch mechanism which is operated based on a signal from the thermistor 35, and the like are structured.

(Frame)

As shown in FIGS. 1 through 3, the frame 7 is provided with a first side plate part 45, which is extended in the "X" direction on a side in the "Y1" direction of the ice tray 5 and the drive part 6, and a second side plate part 46 extended in parallel with the first side plate part 45 on a side in the "Y2" direction of the ice tray 5 and the drive part 6. The ice detection lever 8 is located between the first side plate part 45 and the ice tray 5. Further, the frame 7 is provided with an end plate part 47, which is extended in the "Y" direction and connects ends in the "X1" direction of the first side plate part 45 and the second side plate part 46, and a wall part 48 which is extended in the "Y" direction and connects ends in the "X2" direction of the first side plate part 45 and the second side plate part 46. The wall part 48 is a wall having many holes formed of a plurality of plate-shaped ribs connected with each other. A shaft hole 49 which turnably supports the shaft part 18 of the ice tray 5 is provided at a center of the wall part 48.

In addition, the frame 7 is, as shown in FIGS. 1 and 4, provided with a rectangular support part 50 which projects to the "X2" direction from an upper end of the end plate part 47 and partly connects between the first side plate part 45 and the second side plate part 46 on an upper side with respect to the drive part 6. The drive part 6 is supported by the support part 50.

Further, the frame 7 is provided with a first upper plate part 51 projecting from an upper end of the first side plate part 45 toward the second side plate part 46. The first upper plate part 51 connects an end portion on a side in the "Y1" direction of the support part 50 with an end portion on a side in the "Y1" direction of the upper end of the wall part 48. The first upper plate part 51 is formed with an opening part 51*a* in which an upper end part of the ice detection lever 8 is located on an inner side. In addition, the frame 7 is provided with a second upper plate part 52 which projects from an upper end of the second side plate part 46 toward the first side plate part 45. The second upper plate part 52 connects an end portion on a side in the "Y2" direction of the support part 50 with an end portion on a side in the "Y2" direction of an upper end of the wall part 48. Further, the frame 7 is provided with a water passage constituting part 55 on an upper side (side in the "Z1" direction) of the wall part 48. The water passage constituting part 55 is provided with a projected portion 55*a*, which is projected from the wall part 48 to the "X1" direction and is extended in the "Y" direction, and a protruded portion 55*b* which is protruded from the wall part 48 to the "X2" direction in an end portion in the "Y2" direction.

In this embodiment, as shown in FIG. 4, a substantially rectangular opening part 57 is sectioned on an upper side of the ice tray 5 by the support part 50, the first upper plate part 51, the second upper plate part 52 and the water passage constituting part 55. Since the opening part 57 is formed, when the ice tray 5 is to be reversed between the water storage position 5A and the ice separation position 5B, an interference of an upper end portion of the peripheral wall part 20 of the ice tray 5 moving to an upper side (an upper end portion of the second peripheral wall portion 22, an upper end portion on a side in the "Y2" direction of the third peripheral wall portion 23, and an upper end portion on a side in the "Y2" direction of the fourth peripheral wall portion 24) with the frame 7 is avoided.

The water passage constituting part 55 is provided with a water passage 60 for distributing water supplied from the water supply pipe 2 on its upper face. The water passage 60 is formed to be a concave groove and its upper side is formed in an opened state. The water passage 60 is provided with a first water passage portion 61 extended in the "Y" direction (direction intersecting the axial line "L") along the wall part 48 and a second water passage portion 62 extended from an end portion in the "Y2" direction of the first water passage portion 61 to the "X2" direction along the protruded portion 55*b*. The first water passage portion 61 is overlapped with the projected portion 55*a* and the wall part 48 when viewed in the "Z" direction. Therefore, the projected portion 55*a* is provided with the water passage 60 on its upper face. An end side portion in the "Y1" direction of a bottom face 61*a* of the first water passage portion 61 is provided with a water passage port 64 for water. The water passage port 64 is located on an opposite side to the second water passage portion 62 with the axial line "L" interposing therebetween. The water passage port 64 is formed in a rectangular shape and is provided at an end portion in the "X1" direction in the bottom face 61*a* of the first water passage portion 61. In other words, the water passage port 64 is provided in the projected portion 55*a*. The bottom face 61*a* of the first water passage portion 61 is inclined to a lower side toward the water passage port 64. In other words, the first water passage portion 61 is structured so that the bottom face 61*a* is inclined to a lower side from an end in the "Y1" direction toward the water passage port 64, and the bottom face 61*a* is inclined to a lower side from an end in the "Y2" direction toward the water passage port 64. Further, in the first water passage portion 61, as shown in FIG. 7, a portion of the bottom face 61*a* on a side in the "X2" direction with respect to the water passage port 64 is formed to be a recessed part 61*b* which is recessed by one step, and the recessed part 61*b* is inclined to a lower side as approaching the water passage port 64.

A bottom face 62*a* of the second water passage portion 62 is inclined to a lower side toward a side of the first water passage portion 61 (toward the "X1" direction). In this embodiment, a water supply port 2*a* of the water supply pipe 2 is located on an upper side with respect to the second water passage portion 62.

As shown in FIG. 7, an opening edge of the water passage port 64 in an under face of the projected portion 55*a* of the water passage constituting part 55 is provided with a first guide plate 65, a second guide plate 66 and a third guide plate 67 for guiding water passing through the water passage port 64. The first guide plate 65 is formed in a rectangular shape and is inclined from an opening edge portion in the "X2" direction of the water passage port 64 in the projected portion 55*a* toward a lower side in the "X1" direction. The second guide plate 66 is extended from an opening edge portion in the "Y1" direction of the water passage port 64 in the projected portion 55*a* toward a lower side and is continuously connected with an end edge in the "Y1" direction of the first guide plate 65. The third guide plate 67 is extended from an opening edge portion in the "Y2" direction of the water passage port 64 in the projected portion 55*a* toward a lower side and is continuously connected with an end edge in the "Y2" direction of the first guide plate 65.

In a state that the connecting part 17 of the ice tray 5 is connected with the output shaft 10 of the drive part 6, the drive part 6 is supported by the support part 50 of the frame 7 and, when the shaft part 18 of the ice tray 5 is inserted into the shaft hole 49, as shown in FIGS. 1 through 4, the drive part 6 and the ice tray 5 are supported by the frame 7. When the drive part 6 and the ice tray 5 are supported by the frame 7, the ice tray 5 is set to be turnable around the axial line "L" in a case that the drive part 6 is operated.

Further, in a case that the drive part 6 and the ice tray 5 are supported by the frame 7 and the ice tray 5 is disposed at the water storage position 5A, as shown in FIG. 7, the projected portion 55*a* (frame portion) of the water passage constituting part 55 is located in the "Z1" direction with respect to the water receiving part 26 of the ice tray 5. In addition, the water receiving part 26 (upper face 28*a* of the bottom part 28) of the ice tray 5 and the water passage port 64 provided in the projected portion 55*a* are overlapped with each other when viewed in the "Z" direction. Further, lower ends of the first guide plate 65, the second guide plate 66 and the third guide plate 67 provided in the projected portion 55*a* of the frame 7 are located on a lower side with respect to upper ends of the side plate parts 29 and 30 and the end plate part 31 of the water receiving part 26.

In this embodiment, as shown in FIG. 2, the wall part 48 is provided with an abutting part 70 which is abutted with the water receiving part 26 from a front side in the "CCW" direction when the ice tray 5 is turned in the "CCW" direction around the axial line "L" from the water storage position 5A and has reached the ice separation position 5B. The abutting part 70 is protruded from the wall part 48 in the "X1" direction. The bottom part 28 of the water receiving part 26 is abutted with the abutting part 70. The abutting part 70 is abutted with the water receiving part 26 at the ice separation position 5B to prevent turning of the ice tray 5 which is driven in the "CCW" direction. As a result, the ice tray 5 is twisted.

(Ice Making Operation)

Figure 8A:
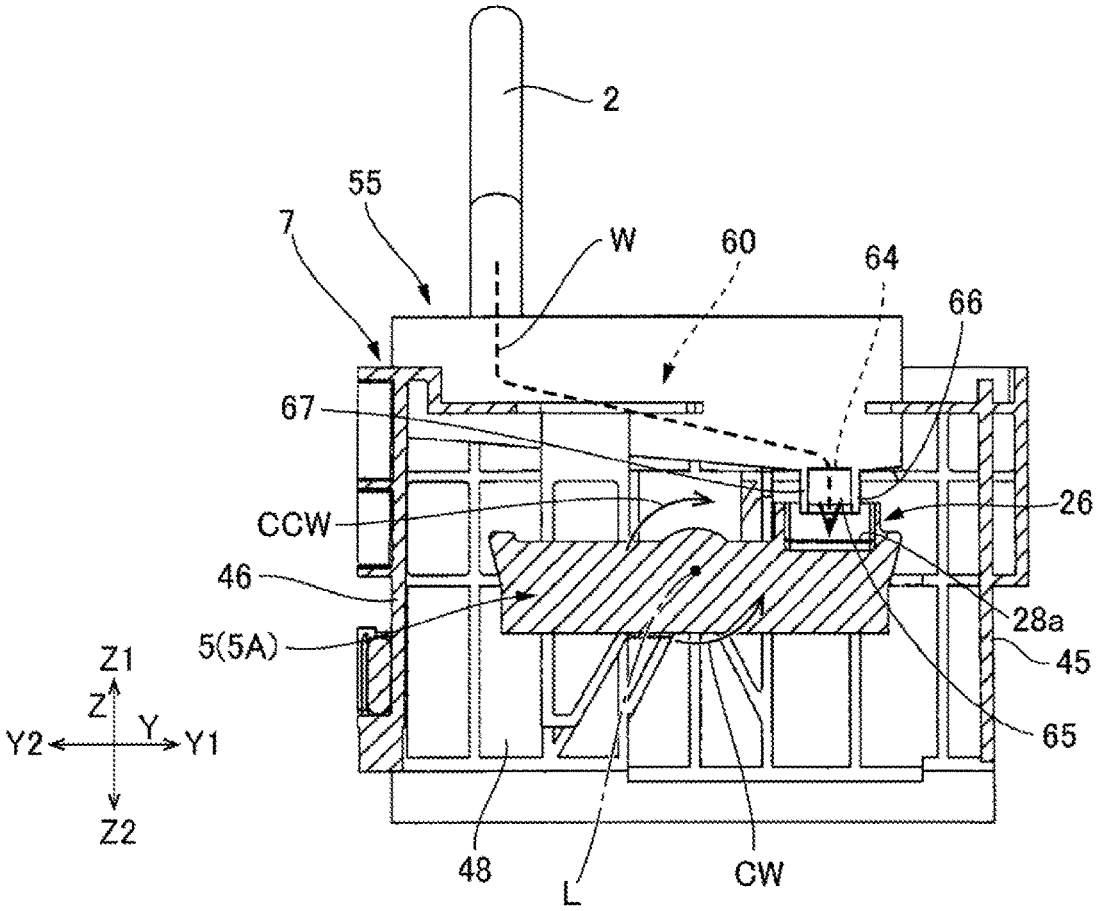
FIGS. 8A and 8B are cross-sectional views showing an ice making machine in a state that an ice tray is located at a water storage position.
Figure 8B:
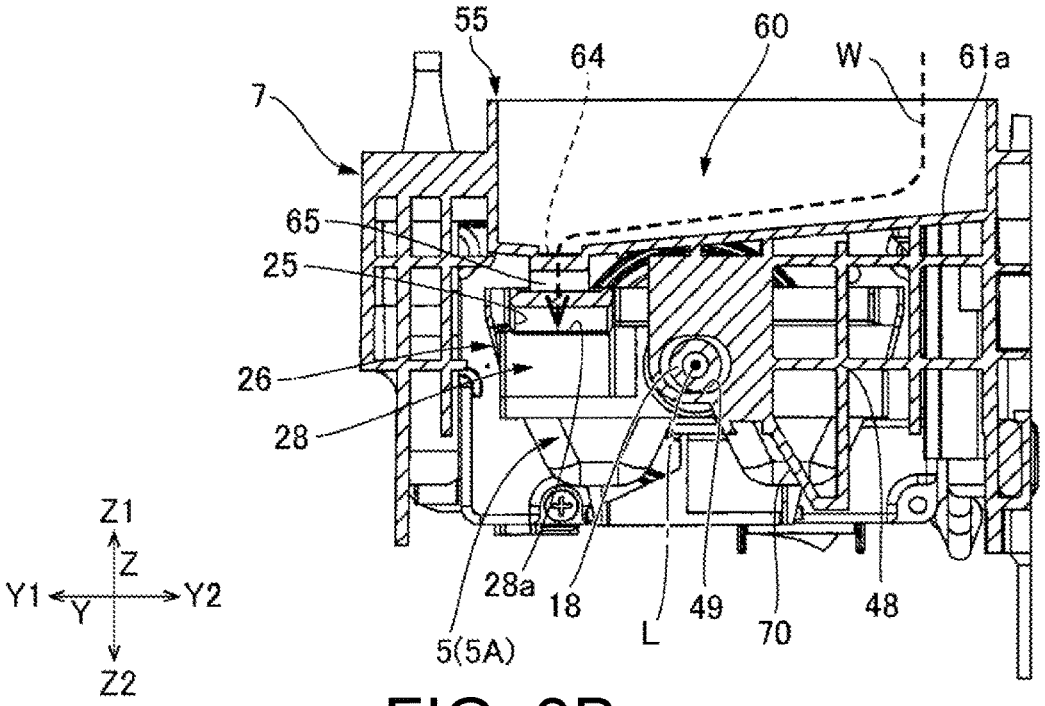
Figure 9A:
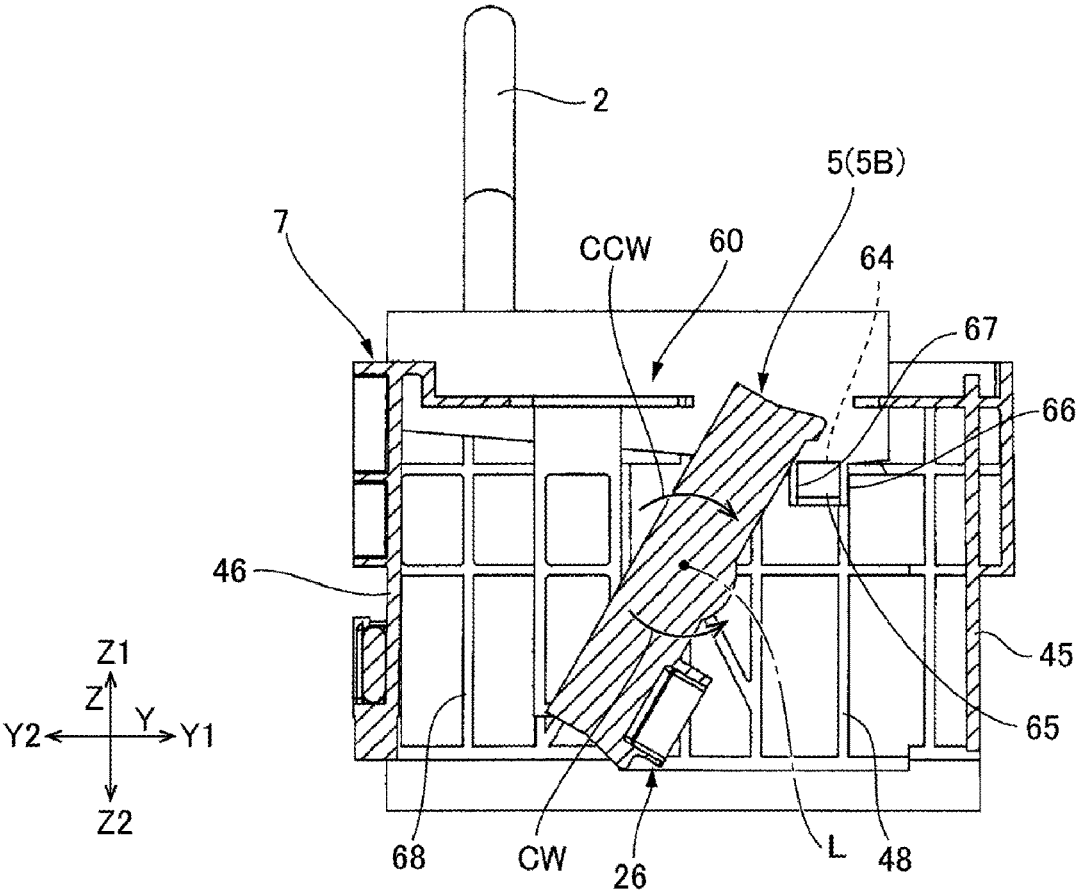
FIGS. 9A and 9B are cross-sectional views showing an ice making machine in a state that an ice tray is located at an ice separation position.
Figure 9B:
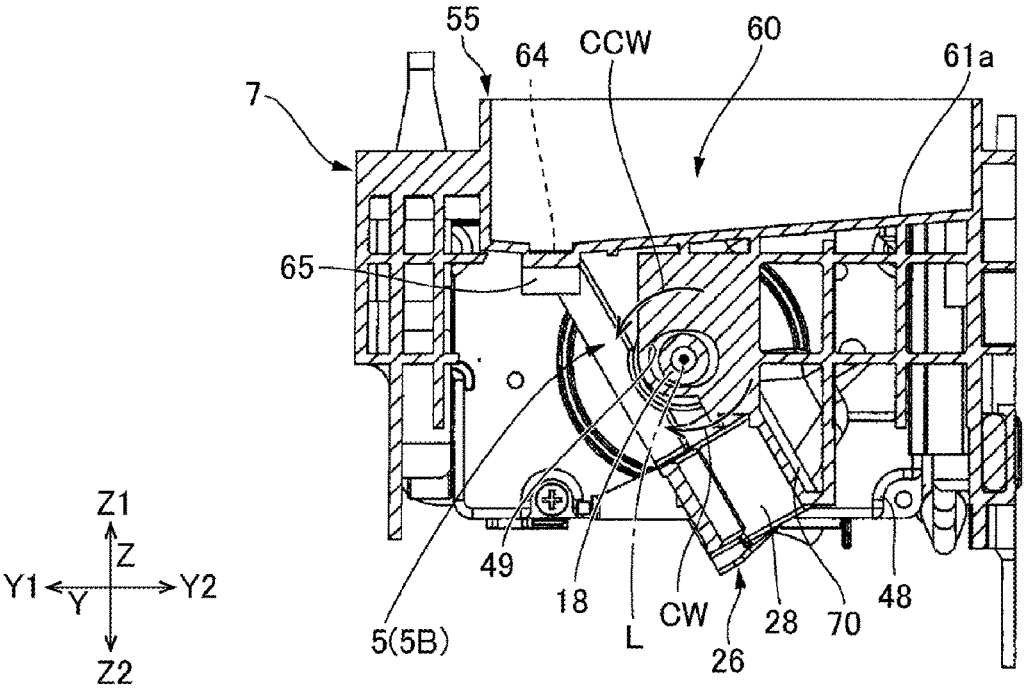

FIGS. 8A and 8B are cross-sectional views showing the ice making machine 1 in a state that the ice tray 5 is located at the water storage position 5A. In FIG. 8A, the ice making machine 1 is cut by a plane perpendicular to the axial line "L" and passing the water receiving part 26 of the ice tray 5 and, in FIG. 8B, the ice making machine 1 is cut by a plane perpendicular to the axial line "L" and passing the abutting part 70 of the wall part 48 of the frame 7. FIGS. 9A and 9B are cross-sectional views showing the ice making machine 1 in a state that the ice tray 5 is located at the ice separation position 5B. In FIG. 9A, the ice making machine 1 is cut by a plane perpendicular to the axial line "L" and passing the water receiving part 26 of the ice tray 5 and, in FIG. 9B, the ice making machine 1 is cut by a plane perpendicular to the axial line "L" and passing the abutting part 70 of the wall part 48 of the frame 7.

In an initial state that an ice making operation is to be started, as shown in FIG. 1, the ice tray 5 is disposed at the water storage position 5A. In this state, a predetermined amount of water is supplied from the water supply pipe 2. As shown by the arrow of a broken chain line in FIGS. 8A and 8B, water "W" supplied from the water supply pipe 2 through the water supply port 2*a* is flowed from the second water passage portion 62 of the water passage 60, passing through the first water passage portion 61, toward the water passage port 64. Further, the water passes the water passage port 64 to be flowed into the water receiving part 26 of the ice tray 5 which is located on its lower side.

In this embodiment, the bottom face 62*a* of the second water passage portion 62 is inclined to a lower side toward a side of the first water passage portion 61. Further, the bottom face 61*a* of the first water passage portion 61 is inclined to a lower side toward the water passage port 64. Therefore, the water supplied from the water supply pipe 2 is flowed toward the water passage port 64 without stagnating. Further, since the bottom face (61*a*, 62*a*) of the water passage 60 is inclined, when the water supply is stopped, it can be prevented or restrained that the water is left and frozen in the water passage 60.

In addition, the projected portion 55*a* of the water passage constituting part 55 is provided with the first guide plate 65, the second guide plate 66 and the third guide plate 67 which are protruded from the opening edge of the water passage port 64 to the "Z2" direction (lower side).

Therefore, the water passing through the water passage port 64 is, when flowed into the water receiving part 26, guided by the first guide plate 65 and directed to a side of the cut-out part 25. Further, the water passing through the water passage port 64 is guided by the second guide plate 66 and the third guide plate 67 and thus, the water passing through the water passage port 64 is prevented or restrained from splashing in the "Y" direction. In addition, as shown in FIG. 7, the water receiving part 26 of the ice tray 5 and the water passage port 64 provided in the projected portion 55*a* are overlapped with each other when viewed in the "Z" direction, and the lower ends of the first guide plate 65, the second guide plate 66 and the third guide plate 67 provided in the projected portion 55*a* of the frame 7 are located on a lower side with respect to the upper ends of the side plate parts 29 and 30 and the end plate part 31 of the water receiving part 26. Therefore, the water passing through the water passage port 64 is surely flowed into the water receiving part 26.

Next, the water flowed into the water receiving part 26 through the water passage port 64 is flowed to the water storage recessed part 9 through the cut-out part 25 of the peripheral wall part 20 of the ice tray 5 and is stored in the water storage recessed parts 9. In this embodiment, the bottom part 28 of the water receiving part 26 facing the water passage port 64 is provided with the upper face 28*a* which is inclined to a lower side ("Z2" direction) toward the cut-out part 25. Therefore, the water flowed into the water receiving part 26 through the water passage port 64 is flowed without stagnating and stored in the water storage recessed parts 9. Further, the ice tray 5 is provided with the peripheral wall part 20 which surrounds openings of the water storage recessed parts 9 and is extended to an upper side. Therefore, the water flowed from the water receiving part 26 to the water storage recessed part 9 through the cut-out part 25 is prevented from splashing from the ice tray 5 to an outer side.

When filling of the water to the water storage recessed parts 9 is completed, the water supply is stopped. After that, the water having been filled in the ice tray 5 is frozen. Whether ice making is completed or not is determined whether the temperature of the ice tray 5 becomes equal to or less than a predetermined temperature or not by the thermistor 35 which is attached to the ice tray 5.

When the ice making is completed, an ice quantity in an ice storage container disposed on a lower side with respect to the ice tray 5 is detected by the ice detection lever 8. Specifically, the ice detection lever 8 is driven and moved down by the drive part 6. In this case, when the ice detection lever 8 has been moved down to a predetermined position, it is judged that an ice quantity in the ice storage container is insufficient. On the other hand, in a case that the ice detection lever 8 is abutted with an ice piece in the ice storage container before having been moved down to the predetermined position, it is judged that an ice quantity in the ice storage container is full. In the case that an ice quantity in the ice storage container is full, after waited for a predetermined time period, an ice quantity in the ice storage container is detected by the ice detection lever 8 again.

When an ice quantity in the ice storage container is insufficient, ice pieces are separated from the ice tray 5 to be dropped into the ice storage container. Specifically, the output shaft 10 is turned in the "CCW" direction by driving the drive part 6 to turn the ice tray 5 in the "CCW" direction around the axial line "L".

In this embodiment, the water receiving part 26 provided in the ice tray 5 so as to be protruded to an outer side is moved to a lower side when the ice tray 5 starts to turn in the "CCW" direction from the water storage position 5A to the ice separation position 5B. In other words, when the ice tray 5 is turned in the "CCW" direction, the water receiving part 26 is moved in a direction separated from the projected portion 55*a* of the water passage constituting part 55 located on an upper side. Therefore, even when the water receiving part 26 is provided in the ice tray 5, the water receiving part 26 is not interfered with a portion of the frame 7.

The ice tray 5 is turned from the water storage position 5A where the ice tray 5 is disposed horizontally to a predetermined turning angle of 90° or more (for example, 120°) and reaches the ice separation position 5B. As shown in FIG. 9B, at the ice separation position 5B, the abutting part 70 of the frame 7 is abutted with the bottom part 28 of the water receiving part 26 of the ice tray 5. In this embodiment, at the time when the water receiving part 26 of the ice tray 5 is abutted with the abutting part 70, although the ice tray 5 is driven in the "CCW" direction by the drive part 6, the ice tray 5 is prevented from turning further to the "CCW" direction because the water receiving part 26 is abutted with the abutting part 70. Therefore, ice tray 5 is twisted and deformed. As a result, ice pieces in the ice tray 5 are detached from the water storage recessed parts 9 to be separated from the ice tray 5 and the ice pieces are dropped to the ice storage container.

After that, the drive part 6 turns the ice tray 5 in the "CW" direction and the ice tray 5 is returned to the water storage position where the water storage recessed parts 9 face upward. After that, the above-mentioned ice making operations are repeated.

(Operations and Effects)

According to this embodiment, water from the water supply pipe 2 is passed through the water passage port 64 provided in the frame 7 and is flowed to the water receiving part 26 protruded to an outer side from the ice tray 5, and then the water is flowed in the water storage recessed parts 9 through the water receiving part 26. Therefore, the water supply port 2*a* of the water supply pipe 2 can be located on an outer side of the ice tray 5. As a result, the water supply port 2*a* of the water supply pipe 2 is not required to dispose at a position separated from a turning area of the ice tray 5 on an upper side with respect to the ice tray 5 and thus, an installation space of the ice making machine 1 including the water supply pipe 2 can be restrained in the upper and lower direction.

Further, in a case that the water supply port 2*a* of the water supply pipe 2 is disposed on an upper side with respect to the ice tray 5, the position of the water supply port 2*a* is required to set on an upper side with respect to a turning area when the ice tray 5 is reversed and thus, a distance between the water supply port 2*a* and the water storage recessed parts 9 is liable to increase. Therefore, water through the water supply port 2*a* of the water supply pipe 2 is liable to splash when the water is flowed to the water storage recessed parts 9 and thus, the peripheral wall part 20 of the ice tray 5 which surrounds openings of a plurality of the water storage recessed parts 9 and is extended to an upper side is required to make higher. On the other hand, like this embodiment, in a case that water from the water supply pipe 2 is passed through the water passage port 64 provided in the frame 7 and is flowed to the water receiving part 26 protruded from the ice tray 5 to an outer side and is flowed to the water storage recessed parts 9, splashing of water flowed to the water storage recessed parts 9 can be prevented or restrained. Therefore, a height of the peripheral wall part 20 can be reduced. As a result, when the ice tray 5 is located at the water storage position 5A, a size of the ice tray 5 can be reduced in the upper and lower direction "Z".

In addition, the water from the water supply pipe 2 is passed through the water passage port 64 provided in the frame 7 and is flowed to the water receiving part 26 protruded to an outer side from the ice tray 5 and is flowed to the water storage recessed parts 9 through the water receiving part 26. Therefore, the water supply port 2*a* of the water supply pipe 2 can be located on an outer side with respect to the ice tray 5. As a result, the water supply port 2*a* of the water supply pipe 2 is not required to dispose at a position separated from a turning area of the ice tray 5 on an upper side with respect to the ice tray 5 and thus, an installation space of the ice making machine 1 including the water supply pipe 2 can be restrained in the upper and lower direction.

Further, in this embodiment, the water receiving part 26 is protruded from the ice tray 5 in a direction along the axial line "L". Therefore, in comparison with a case that the water receiving part 26 is protruded from the ice tray 5 in a direction perpendicular to the axial line "L", a turning area when the ice tray 5 is reversed can be reduced. Accordingly, the size of the ice making machine 1 can be restrained from increasing in a direction perpendicular to the axial line "L".

In addition, the drive part 6 is connected with one side in the axial line "L" direction of the ice tray 5, and the water receiving part 26 is protruded to an outer side from a portion of the ice tray 5 on the other side in the axial line "L" direction. Therefore, even when water flowed to the water receiving part 26 is splashed, the drive part 6 can be prevented or restrained from being sprayed with the water.

Further, the ice tray 5 is made of flexible material, and the frame 7 is provided with the abutting part 70 structured to be abutted with the water receiving part 26 from a front side in the "CCW" direction where the ice tray 5 is directed from the water storage position 5A to the ice separation position 5B. Therefore, the ice tray 5 can be twisted by utilizing the water receiving part 26 and thus, when the ice tray 5 has reached the ice separation position 5B, ice pieces are easily separated from the ice tray 5.

(Modified Example of Water Passage Port and Guide Plate)

Figure 10:
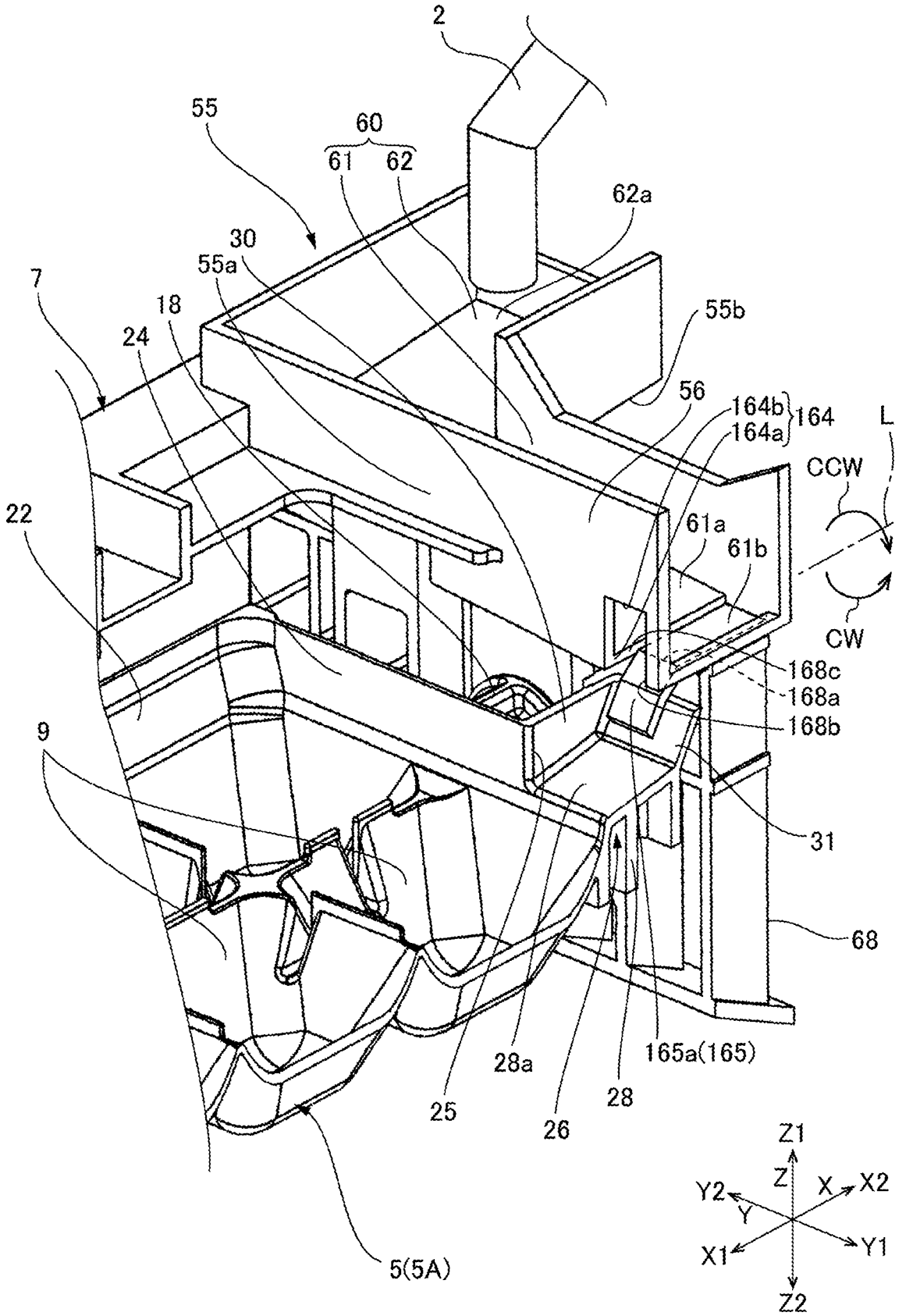
FIG. 10 is a perspective view showing a water passage port and a guide plate in a modified embodiment.

FIG. 10 is a perspective view showing a water passage port and a guide plate in a modified embodiment and is a partial sectional view showing a periphery of the water receiving part 26 of the ice tray 5. A water passage port 164 in a first modified embodiment is, similarly to the embodiment described above, provided in the projected portion 55*a* (frame portion) of the water passage constituting part 55. The projected portion 55*a* is provided with a first water passage wall 56 which is stood up from a bottom face 61*a* of a first water passage portion 61 to an upper side in the "X1" direction side (in other words, a side where water storage recessed parts 9 are located) with respect to the first water passage portion 61. The water passage port 164 is provided at a corner part where the bottom face 61*a* of the first water passage portion 61 and the first water passage wall 56 are connected with each other. The water passage port 164 is provided with a first water passage port portion 164*a* provided at an end part in the "X1" direction of the bottom face 61*a* and a second water passage port portion 164*b* provided in a lower part of the first water passage wall 56. The first water passage port portion 164*a* and the second water passage port portion 164*b* are connected with each other to form one water passage port 164 as a whole. As described above, when the water passage port 164 is enlarged to a side face (first water passage wall 56) on a water storage recessed part 9 side in addition to the bottom face 61*a* of the first water passage portion 61, water is easily flowed to a direction toward the water storage recessed part 9.

The bottom face 61*a* of the first water passage portion 61 is provided with a recessed part 61*b* inclined to a lower side toward the first water passage port portion 164*a* on the "X2" direction side of the first water passage port portion 164*a*. An opening edge of the first water passage port portion 164*a* is provided with a first opening edge portion 168*a* which is an opening edge in the "X2" direction, a second opening edge portion 168*b* which is an opening edge in the "Y1" direction, and a third opening edge portion 168*c* which is an opening edge in the "Y2" direction. The first opening edge portion 168*a* is extended in a direction perpendicular to the axial line "L" direction. Further, the second opening edge portion 168*b* and the third opening edge portion 168*c* are respectively extended from one end and the other end of the first opening edge portion 168*a* in a direction along the axial line "L" and are respectively extended from one end and the other end of the first opening edge portion 168*a* to the "X1" direction (in other words, to a side where the water storage recessed part 9 is located).

The first water passage port portion 164*a* is provided with a guide plate 165 structured to guide water passing through the water passage port 164. The guide plate 165 is formed in a rectangular shape and is extended from the first opening edge portion 168*a* to a lower side. The guide plate 165 is inclined and extended in a direction toward the "X1" direction as going to a lower side and its inclination angle is changed in the middle toward the lower side. An inclination angle with respect to a horizontal direction of a portion on a lower end side of the guide plate 165 is larger than that of a portion on the first opening edge portion 168*a* side of the guide plate 165. Therefore, the guide plate 165 is formed in a bent shape so as to be convex upward as a whole. A lower end of the guide plate 165 is located on a lower side with respect to upper ends of the side plate parts 29 and 30 and the end plate part 31 of the water receiving part 26. Therefore, water having passed through the water passage port 164 is guided by the guide plate 165 and is flowed to the water receiving part 26.

In the water passage port 64 in the embodiment described above, the guide plate (second guide plate 66 and third guide plate 67) is also protruded to a lower side from the opening edge portion in the "Y1" direction and the opening edge portion in the "Y2" direction in addition to the opening edge portion in the "X2" direction. However, in the first modified embodiment, an area where the guide plate is provided is only the first opening edge portion 168*a*, and no guide plate is provided in both of the second opening edge portion 168*b* and the third opening edge portion 168*c*. Therefore, a portion between a side end edge in the "Y1" direction of the guide plate 165 and the second opening edge portion 168*b* is set in a cut-out state. Further, similarly, a portion between a side end edge in the "Y2" direction of the guide plate 165 and the third opening edge portion 168*c* is set in a cut-out state. In other words, a space is provided between the side end edge of the guide plate 165 and the second opening edge portion 168*b*, and a space is provided between the side end edge of the guide plate 165 and the third opening edge portion 168*c*. Therefore, in the modified embodiment in FIG. 10, corner parts which connect the side end edges of the guide plate 165 with other guide plates are not formed and thus, water is hard to be left in the guide plate 165. Accordingly, occurrence of a situation that the water passage port 164 is closed due to freezing, or that water is hard to pass through the water passage port 164 due to freezing can be reduced.

(Example with Groove in Guide Plate)

Figure 11:
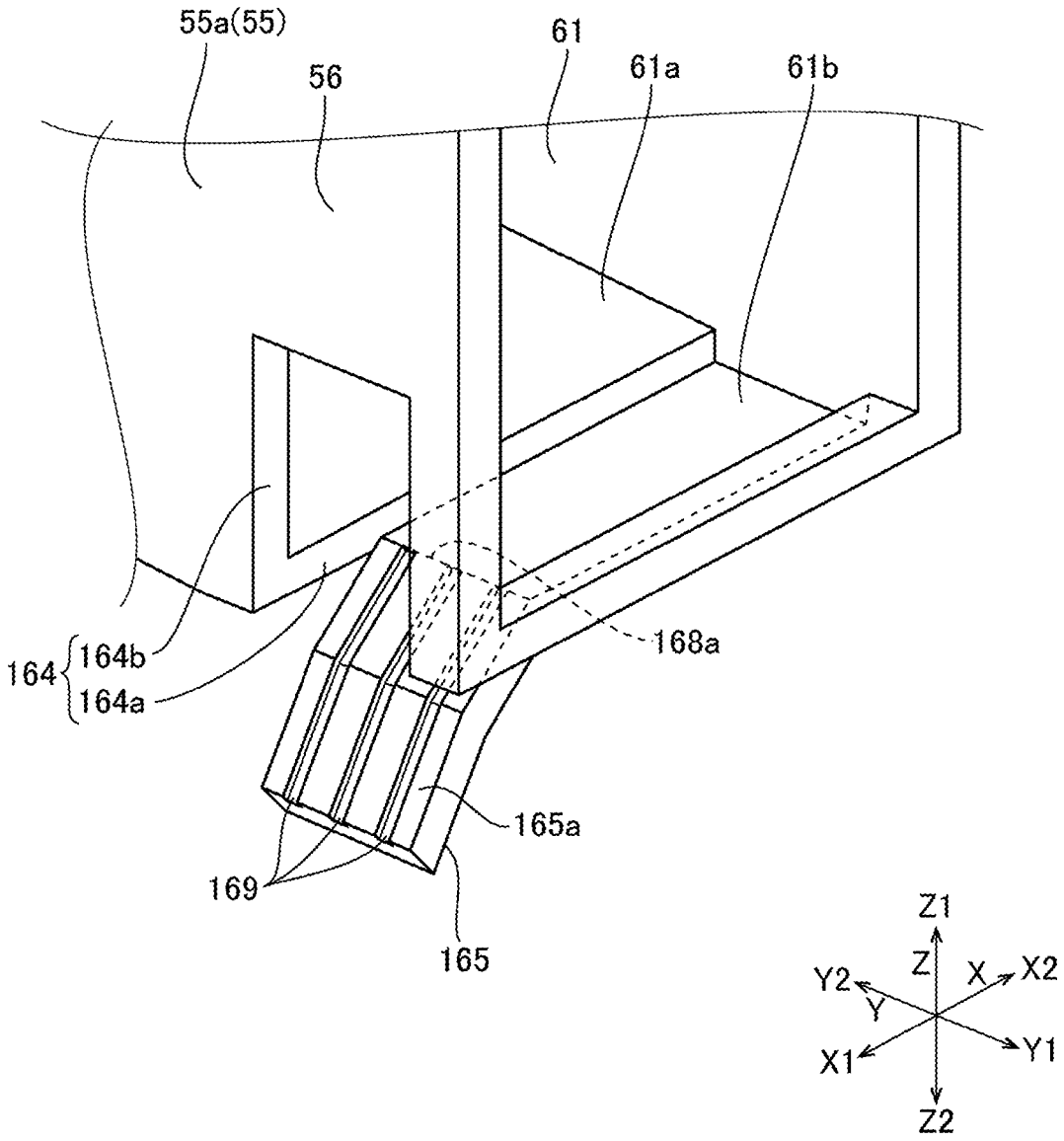
FIG. 11 is a perspective view showing an example in which a groove is provided in a guide plate.

FIG. 11 is a perspective view showing an example in which grooves 169 are provided in the guide plate 165. The guide plate 165 is provided with a guide face 165*a* facing upward. The guide face 165*a* is inclined toward the "X1" direction as going to a lower side. Water passing through the water passage port 164 is flowed on the guide face 165*a* and is flowed to the water receiving part 26. The guide face 165*a* is provided with a plurality of grooves 169 which are extended to a lower side. The plurality of the grooves 169 is arranged side by side in a direction intersecting a direction toward a lower end of the guide face 165*a*. In this embodiment, a plurality of the grooves 169 is arranged in the "Y" direction at a constant interval. Each of the grooves 169 is extended from the first opening edge portion 168*a* to the lower end of the guide plate 165.

As shown in FIG. 11, when the grooves 169 for draining are provided in the guide face 165*a*, water adhered to the guide face 165*a* can be gathered to the groove 169 and thus the water is easily flowed to a lower side. Therefore, water is hard to be left on the guide face 165*a* and thus, occurrence of a situation that the water passage port 164 is closed due to freezing, or that water is hard to pass through the water passage port 164 due to freezing can be reduced.

In FIG. 11, a plurality of the grooves 169 is provided in the entire area from the first opening edge portion 168*a* to the lower end of the guide face 165*a*. Therefore, water is hard to be left on the guide face 165*a*. In this case, the groove 169 may be provided only in a part of the guide face 165*a*, and the number and arrangement of the grooves 169 may be changed as necessary. Further, it is desirable that the groove 169 is extended to the lower end of the guide face 165*a*. When the groove 169 is extended to the lower end of the guide face 165*a*, water gathered in the groove 169 is easily flowed to the water receiving part 26. Therefore, water is hard to be left on the guide face 165*a* and freezing of water is hard to occur.

Figure 12:
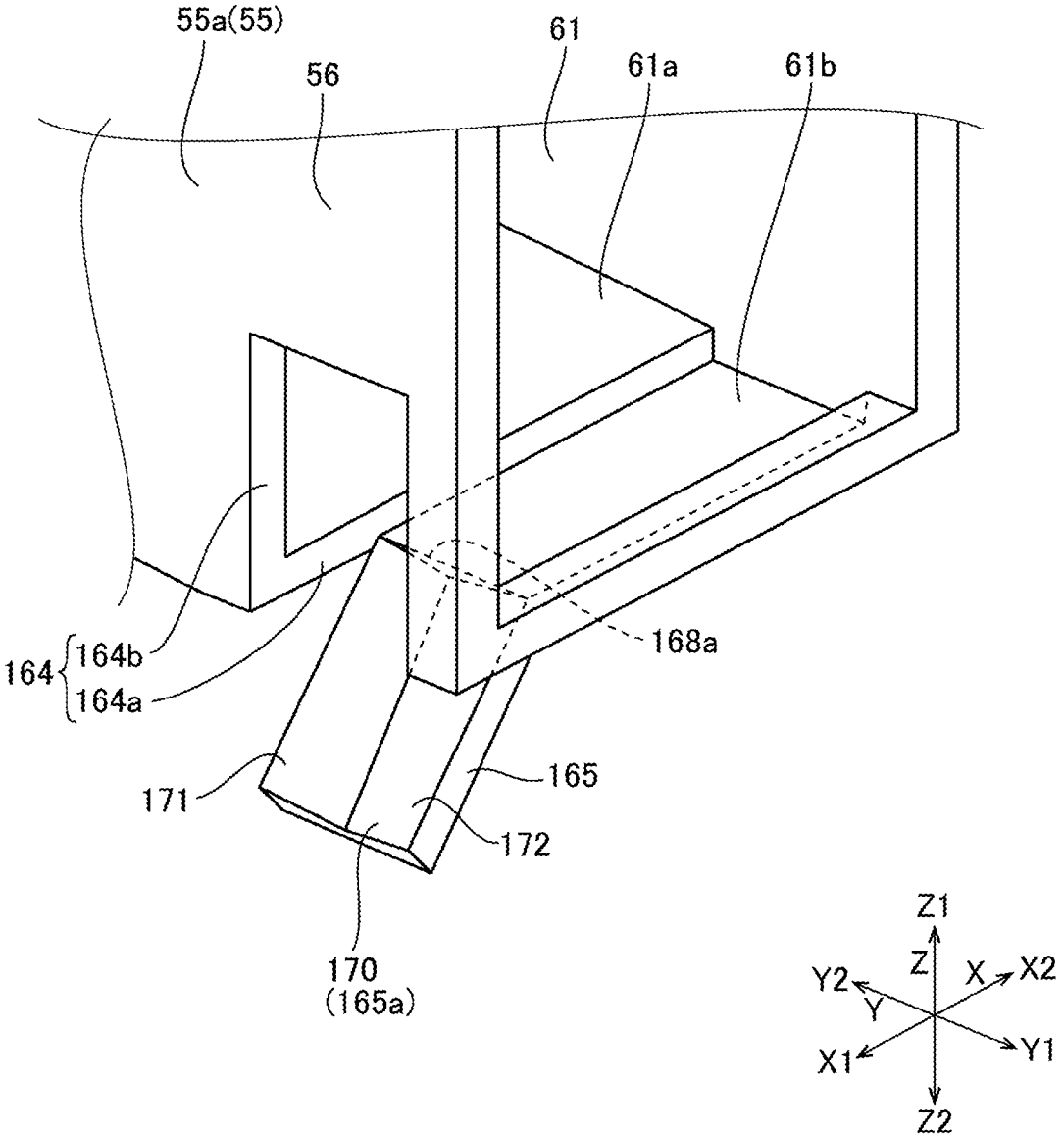
FIG. 12 is a perspective view showing an example in which a groove having another shape is provided in a guide plate.

FIG. 12 is a perspective view showing an example in which a groove 170 having another shape is provided in the guide plate 165. In the example in FIG. 11, a shape of the groove 169 is a thin groove in which a groove depth is constant, and the groove depth and a groove width are substantially the same as each other. However, a groove 170 in FIG. 12 is a valley-shaped groove whose groove depth increases as going to a center in a width direction of the groove 170. The groove 170 is provided with a first inclination part 171 inclined in a direction toward a lower side as going to the "Y1" direction and a second inclination part 172 inclined in a direction toward a lower side as going to the "Y2" direction. The first inclination part 171 and the second inclination part 172 are reversely inclined to each other and are connected with each other at a center in the width direction of the groove 170 so as to form a predetermined angle. In a case that the groove 170 having the above-mentioned shape is provided, water is easily gathered to a center in the width direction of the groove 170 and thus, water is easily flowed to a lower side. Therefore, water is hard to be left on the guide face 165*a* and freezing of water is hard to occur.

In FIG. 12, the entire guide face 165*a* is structured so as to form one groove 170. However, a plurality of valley-shaped grooves may be provided in the guide face 165*a*. Further, the groove 170 may be provided in only a part of the guide face 165*a* instead of the entire guide face 165*a*.

Other Modified Embodiments

In the embodiment described above, the water supply port 2*a* of the water supply pipe 2 is disposed so as to be located on an upper side of the second water passage portion 62 of the water passage 60. However, the water supply pipe 2 may be disposed so that the water supply port 2*a* is located on an upper side of the first water passage portion 61. In this case, the water supply port 2*a* may be disposed at any position in the "Y" direction. Therefore, a degree of freedom of installation of the water supply pipe 2 is improved.

Further, the water receiving part 26 may be provided so as to protrude from the first peripheral wall portion 21 of the peripheral wall part 20 of the ice tray 5 to a direction perpendicular to the axial line "L". In this case, a cut-out part 25 is provided in the first peripheral wall portion 21 of the peripheral wall part 20, and the water receiving part 26 and the water storage recessed part 9 are communicated with each other through the cut-out part 25. Further, when the ice tray 5 is disposed at the water storage position 5A, a water passage port 64 is provided in the first upper plate part 51 at a position overlapping with the water receiving part 26 when viewed in the "Z" direction, and a water passage 60 is extended in the "X" direction along the first upper plate part 51 to a position where the water passage port 64 is provided.

The invention claimed is:

1. An ice making machine, comprising:

an ice tray comprising a water storage recessed part structured to store water supplied through a water supply pipe;

a drive part structured to reverse the ice tray around an axial line passing the ice tray between a water storage position where the water storage recessed part faces upward and an ice separation position where the water storage recessed part faces downward; and a frame which supports the ice tray and the drive part;

wherein the ice tray comprises a water receiving part protruded to an outer side in an ice tray portion which is moved to a lower side when the ice tray starts to turn to a first turning direction directing from the water storage position to the ice separation position;

wherein the frame comprises a frame portion located on an upper side with respect to the water receiving part;

wherein the frame portion comprises a water passage port structured to pass the water at a position overlapping with the water receiving part when the ice tray located at the water storage position is viewed in an upper and lower direction;

wherein the water receiving part is communicated with the water storage recessed part; and wherein the frame portion comprises a water passage provided with a first water passage portion and a second water passage portion, wherein the first water passage portion is extended in a direction intersecting the axial line on an upper face of the frame portion, and the second water passage portion is extended in a direction parallel to the axial line on the upper face of the frame portion, at least a part of the water passage port is provided in a bottom face of the first water passage portion of the water passage, and the bottom face of the first water passage portion is inclined to a lower side toward the water passage port;

an end side portion of the bottom face of the first water passage portion is provided with the water passage port, wherein the water through the water supply pipe is passed through the second water passage portion, the first water passage portion, the water passage port and the water receiving part, and is flowed to the water storage recessed part.

2. The ice making machine according to claim 1, wherein the water receiving part is protruded from the ice tray in a direction along the axial line.

3. The ice making machine according to claim 1, wherein the drive part is connected with one side in a direction of the axial line of the ice tray, and the water receiving part is protruded to the outer side from a portion on an other side in the direction of the axial line in the ice tray portion.

4. The ice making machine according to claim 3, wherein the ice tray is made of flexible material, and the frame comprises an abutting part structured to abut with the water receiving part from a front side in the first turning direction when the ice tray is turned in the first turning direction and has reached the ice separation position and, thereby turning of the ice tray driven to the first turning direction is prevented.

5. The ice making machine according to claim 1, wherein the frame portion comprises a guide plate which is protruded from the water passage port to a lower side and guides the water passing through the water passage port to the water receiving part.

6. The ice making machine according to claim 5, wherein the water passage port comprises:

a first opening edge portion extended in a direction intersecting the axial line in the bottom face of the water passage; and a second opening edge portion and a third opening edge portion which are respectively extended from one end and an other end of the first opening edge portion to a side where the water storage recessed part is located in the bottom face of the water passage, and the guide plate is extended from the first opening edge portion to the lower side.

7. The ice making machine according to claim 6, wherein the guide plate comprises a groove which is extended to the lower side in at least a part of the guide plate, and the groove is extended to a lower end of the guide plate.

8. The ice making machine according to claim 7, wherein the groove comprises a plurality of grooves which are arranged side by side in a direction intersecting a direction toward the lower end of the guide plate.

9. The ice making machine according to claim 5, wherein the frame portion comprises a first water passage wall which is stood up from the bottom face of the water passage to an upper side on a side where the water storage recessed part is located with respect to the water passage, and the water passage port comprises a first water passage port portion provided in the bottom face of the water passage and a second water passage port portion which is provided in the first water passage wall and is connected with the first water passage port portion.

10. The ice making machine according to claim 5, wherein the ice tray comprises:

a peripheral wall part which surrounds an opening of the water storage recessed part and is extended to an upper side when the ice tray is disposed at the water storage position; and a cut-out part provided in a part in a circumferential direction of the peripheral wall part, wherein when the ice tray is disposed at the water storage position, the water receiving part comprises:

a bottom part which is protruded to the outer side from an edge portion on a lower side of the cut-out part in the peripheral wall part and faces the frame portion;

a pair of side plate parts which are respectively protruded to the outer side from an edge portion on one side and an edge portion on an other side of the cut-out part in the circumferential direction of the peripheral wall part, and lower ends of the pair of the side plate parts being continuously connected with the bottom part; and an end plate part which is continuously connected with a tip end portion of the bottom part and tip end portions of the pair of the side plate parts, and a lower end of the guide plate is located on a lower side with respect to upper ends of the pair of the side plate parts when the ice tray is disposed at the water storage position.

11. The ice making machine according to claim 1, wherein the ice tray comprises:

a peripheral wall part which surrounds an opening of the water storage recessed part and is extended to an upper side when the ice tray is disposed at the water storage position; and a cut-out part provided in a part in a circumferential direction of the peripheral wall part, and the water receiving part is protruded from the peripheral wall part to an outer side and is communicated with the water storage recessed part through the cut-out part.

12. The ice making machine according to claim 11, wherein when the ice tray is disposed at the water storage position, the water receiving part comprises:

a bottom part which is protruded to the outer side from an edge portion on a lower side of the cut-out part in the peripheral wall part and faces the frame portion;

a pair of side plate parts which are respectively protruded to the outer side from an edge portion on one side and an edge portion on an other side of the cut-out part in the circumferential direction of the peripheral wall part, and lower ends of the pair of the side plate parts being continuously connected with the bottom part; and an end plate part which is continuously connected with a tip end portion of the bottom part and tip end portions of the pair of the side plate parts, and the bottom part comprises an upper face which is inclined to a lower side from a side of the end plate part toward a side of the peripheral wall part.

* * * * *